US009146516B2

(12) United States Patent
Morishita

(10) Patent No.: US 9,146,516 B2
(45) Date of Patent: Sep. 29, 2015

(54) IMAGE FORMING APPARATUS THAT PERFORMS INSPECTION OF PRINTED MATTER, METHOD OF CONTROLLING THE SAME, AND STORAGE MEDIUM

(71) Applicant: CANON KABUSHIKI KAISHA, Tokyo (JP)

(72) Inventor: Yusuke Morishita, Inagi (JP)

(73) Assignee: CANON KABUSHIKI KAISHA (JP)

( * ) Notice: Subject to any disclaimer, the term of this patent is extended or adjusted under 35 U.S.C. 154(b) by 0 days.

(21) Appl. No.: 14/317,566

(22) Filed: Jun. 27, 2014

(65) Prior Publication Data

US 2015/0003845 A1 Jan. 1, 2015

(30) Foreign Application Priority Data

Jul. 1, 2013 (JP) ..... 2013-137954

(51) Int. Cl.
*G03G 15/00* (2006.01)

(52) U.S. Cl.
CPC ..... *G03G 15/55* (2013.01); *G03G 15/5062* (2013.01); *G03G 2215/0141* (2013.01)

(58) Field of Classification Search
CPC . G03G 15/553; G03G 15/55; G03G 15/5062; G03G 2215/0141
USPC ..... 399/15; 382/112
See application file for complete search history.

(56) References Cited

U.S. PATENT DOCUMENTS 8,457,362 B2 * 6/2013 Komoto ..... 382/112
8,983,311 B2 * 3/2015 Nemoto et al. ..... 382/112
2008/0260395 A1 * 10/2008 Honma ..... 399/15

FOREIGN PATENT DOCUMENTS

JP 2005-144797 A 6/2005

* cited by examiner

*Primary Examiner* — William J Royer
(74) *Attorney, Agent, or Firm* — Rossi, Kimms & McDowell LLP

(57) ABSTRACT

An image forming apparatus capable of inspecting printed matter as a recording sheet on which an image including a copy forgery-inhibited pattern has been printed. An image is printed on a sheet based on print image data. Scanned image data is acquired by reading the printed sheet. Reference data is created by excluding image data representative of image portions which cannot be read from the print image data. It is determined whether or not the printed sheet is free from defective printing by comparing the scanned image data and the reference data.

11 Claims, 20 Drawing Sheets

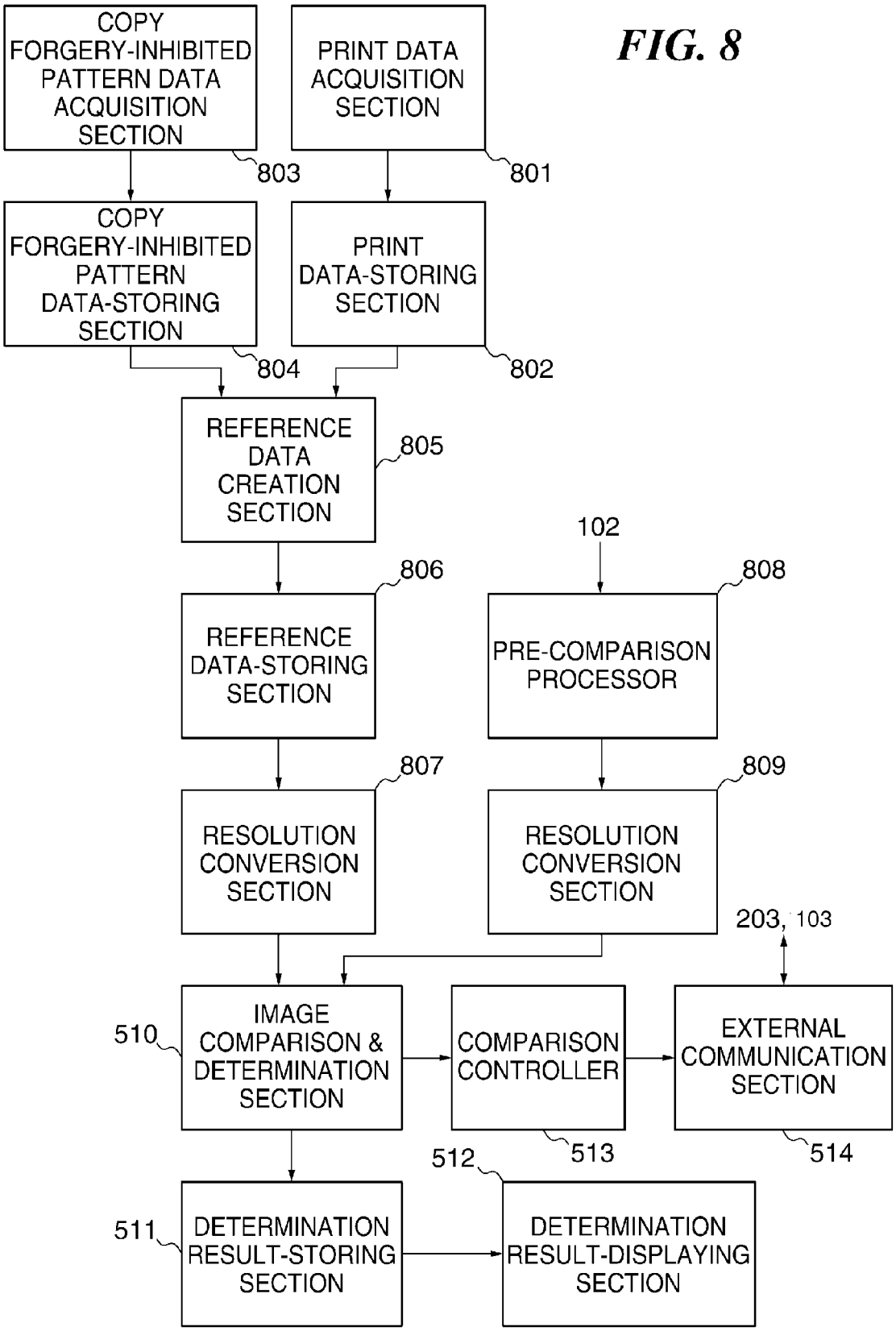
FIG. 8
COPY FORGERY-INHIBITED PATTERN DATA ACQUISITION SECTION
803
PRINT DATA ACQUISITION SECTION
801
COPY FORGERY-INHIBITED PATTERN DATA-STORING SECTION
804
PRINT DATA-STORING SECTION
802
REFERENCE DATA CREATION SECTION
805
102
806
808
REFERENCE DATA-STORING SECTION
PRE-COMPARISON PROCESSOR
807
809
RESOLUTION CONVERSION SECTION
RESOLUTION CONVERSION SECTION
203, 103
510
IMAGE COMPARISON & DETERMINATION SECTION
COMPARISON CONTROLLER
EXTERNAL COMMUNICATION SECTION
513
514
512
511
DETERMINATION RESULT-STORING SECTION
DETERMINATION RESULT-DISPLAYING SECTION

SCANNED IMAGE DATA ON WHICH LATENT IMAGE HAS NORMALLY APPEARED

PRINTED MATTER ON WHICH LATENT IMAGE IS NORMALLY HIDDEN

IMAGE FORMING APPARATUS THAT PERFORMS INSPECTION OF PRINTED MATTER, METHOD OF CONTROLLING THE SAME, AND STORAGE MEDIUM

BACKGROUND OF THE INVENTION

1. Field of the Invention

The present invention relates to an image forming apparatus that performs inspection of printed matter, a method of controlling the same, and a storage medium.

2. Description of the Related Art

Conventionally, inspection work of printed matter has been performed by visual inspection by an inspector based on his/her experiences. In this case, visual inspection of an enormous amount of printed matter for confirmation puts a large burden on the inspector, and further, there is a high possibility of an inspection error.

Further, to visually inspect printed matter which is output from an image forming apparatus at a high speed is not excellent in working efficiency.

Therefore, there has been a demand for automatically inspecting printed matter printed by an image forming apparatus capable of high-speed small-amount various-type production, in synchronism with printing of the printed matter.

To meet this demand, in recent years, there has been developed an inspection system that makes it possible to detect a defect in print processing, such as dirt, a void, and skew in printing, by reading printed matter printed by the image forming apparatus by a sensor, performing image processing on the read data, and then comparing the read data with print data which is original data.

Further, there has been disclosed a technique in which a finisher having a plurality of output ports is controlled based on a result of inspection on printed matter, and the output port for outputting printed matter is changed between one for printed matter on which printing has been normally performed and the other for printed matter on which a printing defect is detected, thereby making it possible to sort out the printed matter having the printing defect (see e.g. Japanese Patent Laid-Open Publication No. 2005-144797).

Further, some of receipts, securities, and certificates have a background on which is printed a special pattern including characters or images which will appear when copied, so as to prevent them from being easily copied.

Such a special pattern is called a copy forgery-inhibited pattern, and provides a contrivance that prevents an original from being easily duplicated by copying, to thereby realize an effect of preventing copying of the original.

The copy forgery-inhibited pattern is formed by two areas equal in density: an area in which dots remain when copied and an area in which dots disappear when copied. These two areas are substantially equal in density, and hidden characters or images, such as "COPY", are not recognized at a glance. These hidden characters and images are referred to as the "latent image".

For example, large dots are dispersed in a latent image part which is an area in which dots remain after copying, and small dots are concentrated in a background part which is an area in which dots disappear when copied. This makes it possible to create these two areas which are substantially equal in density, but are different in characteristics.

In general, in copying an image, there exists a limit in image reproduction capability dependent on an input resolution for reading fine dots in the image and an output resolution for reproducing the fine dots. Therefore, if isolated fine dots exceeding the limit of the image reproduction capability exist in an image, the fine dots cannot be properly reproduced in a copy of the image, and as a result, the copy misses the part of the isolated fine dots. This causes only large dots to appear to make the copy forgery-inhibited pattern noticeable, whereby it is possible to prevent the image from being duplicated.

This copy forgery-inhibited pattern does not function to prevent forgery unless the dots in the latent image part and the background part are correctly printed, respectively. For example, in a case where dots in the latent image part are too small, the dots cannot be read when scanning the image, and the latent image is not left on a sheet to which the original is copied, and hence the copy forgery-inhibited pattern cannot provide a security function.

Further, in a case where dots in the background part are too large, the background dots are also read when scanning the image, so that even the image in the background part is left after copying.

Conventionally, to check whether or not the copy forgery-inhibited pattern is correctly printed, it is necessary to scan a sheet on which a copy forgery-inhibited pattern has been printed and visually check whether or not the latent image has appeared. However, this method is not efficient enough to check a huge amount of originals, and is lower in productivity.

To overcome the inconvenience, when inspecting a print sheet on which a copy forgery-inhibited pattern has been printed using the technique disclosed in Japanese Patent Laid-Open Publication No. 2005-144797, the conventional inspection system uses print data as reference data to be compared with data read by an inspection section.

However, in a case where the copy forgery-inhibited pattern is printed, the print data and the copy forgery-inhibited pattern are printed, and hence if the print data is used as the reference data, the inspection determines that the printed matter is defective. This means that it is impossible to properly perform the inspection.

SUMMARY OF THE INVENTION

The present invention provides an image forming apparatus that is capable of inspecting printed matter which is a recording sheet on which an image including a copy forgery-inhibited pattern has been printed, a method of controlling the same, and a storage medium.

In a first aspect of the present invention, there is provided an image forming apparatus comprising a printing unit configured to perform printing on a sheet based on print image data, a reading unit configured to read the sheet on which printing has been performed by the printing unit to thereby acquire inspection product image data, a generation unit configured to generate reference image data formed by excluding data representative of image portions which cannot be read by the reading unit, from the print image data, and a determination unit configured to determine whether or not the sheet on which printing has been performed is free from defective printing by comparing the inspection product image data and the reference image data.

In a second aspect of the present invention, there is provided an image forming apparatus comprising a printing unit configured to perform printing on a sheet based on synthesized image data formed by synthesizing copy forgery-inhibited pattern image data formed by image data representative of large dots and image data representative of small dots, and print image data, a reading unit configured to read the sheet on which printing has been performed by the printing unit to thereby acquire inspection product image data, a generation unit configured to generate reference image data formed by the image data representative of the large dots and the print image data without including image data representative of the small dots, and a determination unit configured to determine whether or not the sheet on which printing has been performed is free from defective printing by comparing the inspection product image data and the reference image data.

In a third aspect of the present invention, there is provided a method of controlling an image forming apparatus, comprising performing printing on a sheet based on print image data, reading the sheet on which printing has been performed to thereby acquire inspection product image data, generating reference image data formed by excluding data representative of image portions which cannot be read by said reading, from the print image data, and determining whether or not the sheet on which printing has been performed is free from defective printing by comparing the inspection product image data and the reference image data.

In a fourth aspect of the present invention, there is provided a method of controlling an image forming apparatus, comprising performing printing on a sheet based on synthesized image data formed by synthesizing copy forgery-inhibited pattern image data formed by image data representative of large dots and image data representative of small dots, and print image data, reading the sheet on which printing has been performed to thereby acquire inspection product image data, generating reference image data formed by the image data representative of the large dots and the print image data without including image data representative of the small dots, and determining whether or not the sheet on which printing has been performed is free from defective printing by comparing the inspection product image data and the reference image data.

In a fifth aspect of the present invention, there is provided a non-transitory computer-readable storage medium storing a computer-executable program for executing a method of controlling an image forming apparatus, wherein the method comprises performing printing on a sheet based on print image data, reading the sheet on which printing has been performed to thereby acquire inspection product image data, generating reference image data formed by excluding data representative of image portions which cannot be read by said reading, from the print image data, and determining whether or not the sheet on which printing has been performed is free from defective printing by comparing the inspection product image data and the reference image data.

In a sixth aspect of the present invention, there is provided a non-transitory computer-readable storage medium storing a computer-executable program for executing a method of controlling an image forming apparatus, wherein the method comprises performing printing on a sheet based on synthesized image data formed by synthesizing copy forgery-inhibited pattern image data formed by image data representative of large dots and image data representative of small dots, and print image data, reading the sheet on which printing has been performed to thereby acquire inspection product image data, generating reference image data formed by the image data representative of the large dots and the print image data without including image data representative of the small dots, and determining whether or not the sheet on which printing has been performed is free from defective printing by comparing the inspection product image data and the reference image data.

According to the present invention, it is possible to provide an image forming apparatus that is capable of inspecting printed matter which is a recording sheet on which an image including a copy forgery-inhibited pattern has been printed, a method of controlling the same, and a storage medium.

Further features of the present invention will become apparent from the following description of exemplary embodiments (with reference to the attached drawings).

BRIEF DESCRIPTION OF THE DRAWINGS

FIG. 8 is a schematic block diagram of an inspection processor appearing in FIG. 6.

DESCRIPTION OF THE EMBODIMENTS

The present invention will now be described in detail below with reference to the accompanying drawings showing embodiments thereof. Note that in the following description, to form an image on a recording sheet is sometimes simply referred to as "print".

Figure 1:
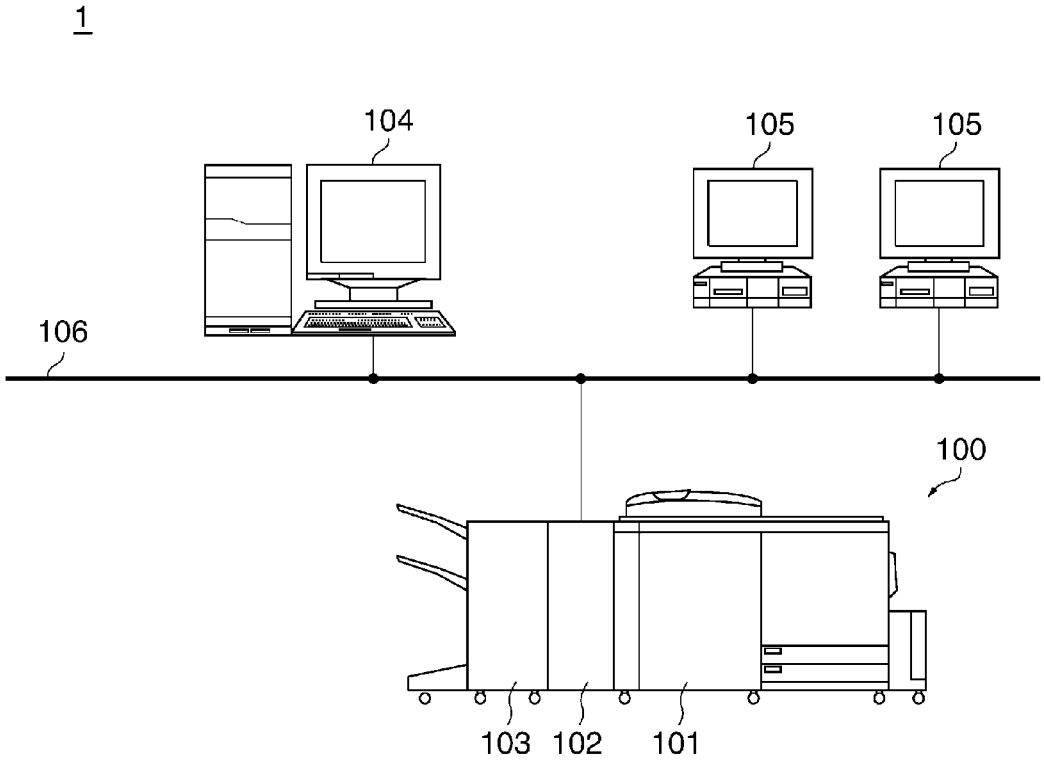
FIG. 1 is a schematic diagram of an image forming system including an image forming apparatus according to a first embodiment of the present invention.

FIG. 1 is a schematic diagram of an image forming system 1 including an image forming apparatus 100 according to a first embodiment of the present invention.

Referring to FIG. 1, the image forming system 1 comprises a print server 104, client PCs 105, and the image forming apparatus 100, which are connected via a network 106.

Further, the image forming apparatus 100 comprises an image forming unit 101, an inspection unit 102, and a finisher 103.

The image forming unit 101 processes and prints various input data. Further, the inspection unit 102 receives printed matter output from the image forming unit 101, and inspects whether it is properly output. The finisher 103 receives the printed matter inspected by the inspection unit 102, and outputs the finished printed matter.

As described above, the present embodiment describes, by way of example, the image forming apparatus to which is applied an in-line inspection machine that performs all required operations from image formation, through inspection, up to finishing.

Figure 2:
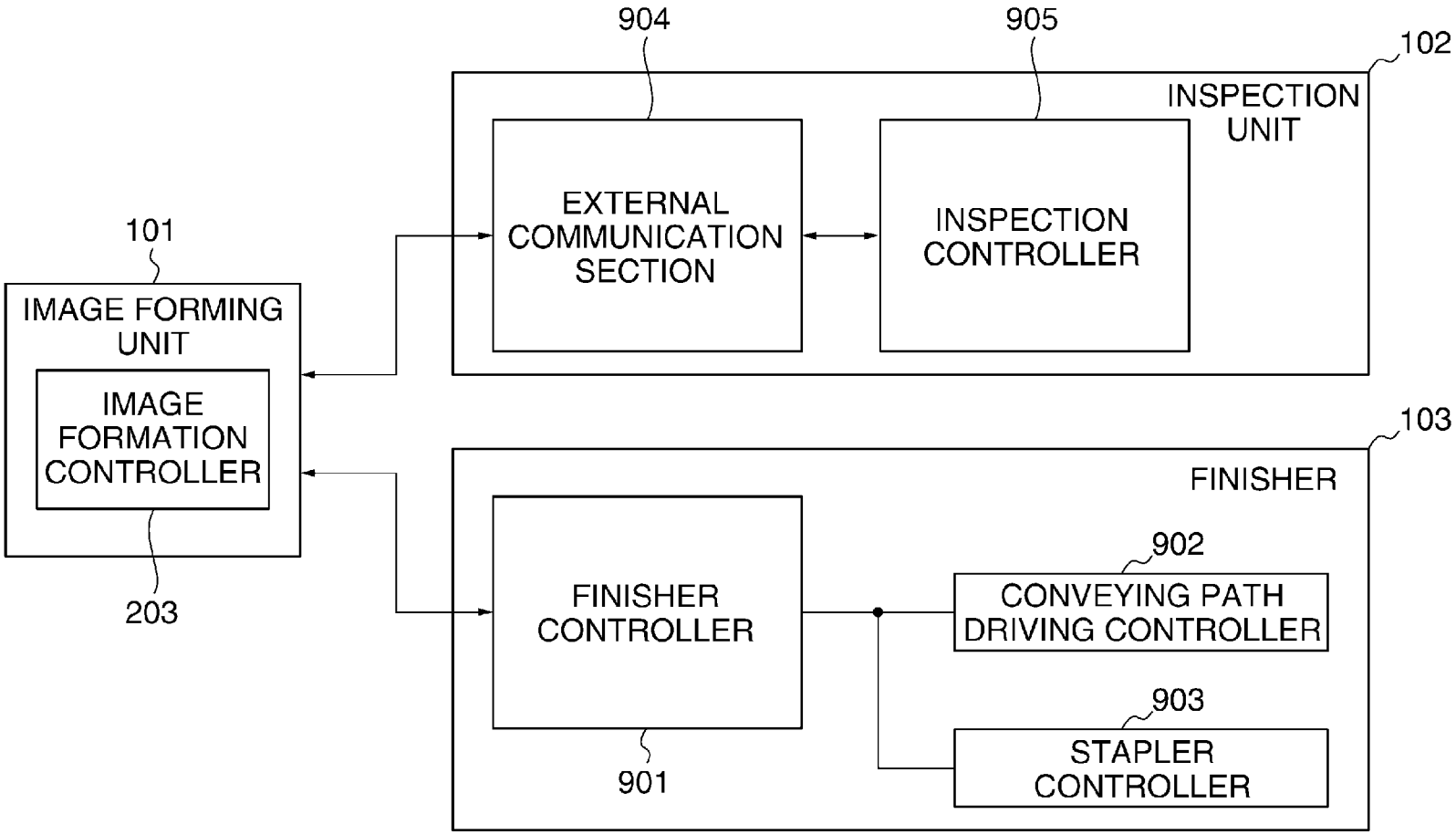
FIG. 2 is a diagram showing respective control-related sections of an image forming unit, an inspection unit, and a finisher of the image forming apparatus appearing in FIG. 1, and a connection relationship between them.

FIG. 2 is a diagram showing respective control-related sections of the image forming unit 101, the inspection unit 102, and the finisher 103, appearing in FIG. 1, and a connection relationship between them.

Referring to FIG. 2, an image formation controller 203 of the image forming unit 101 is connected to an external communication section 904 of the inspection unit 102 and a finisher controller 901 of the finisher 103 via respective dedicated communication lines.

The finisher controller 901 receives finisher setting information of a job from the image forming unit 101, and controls functions of the finisher 103 based on the received finisher setting information.

A conveying path driving controller 902 guides sheets to various finishing units based on job control information sent from the finisher controller 901.

For example, when outputting printed matter after performing staple processing thereon, the conveying path driving controller 902 communicates with a stapler controller 903, and the finisher controller 901 receives status information from the stapler controller 903 and sends job control information to the same, whereby the stapler operation based on information of the job is performed.

The external communication section 904 communicates with the image forming unit 101 to receive operation control information and transmit scanned image data.

An inspection controller 905 performs scanning of print data and let-pass-through control based on the control information received from the external communication section 904.

Figure 3:
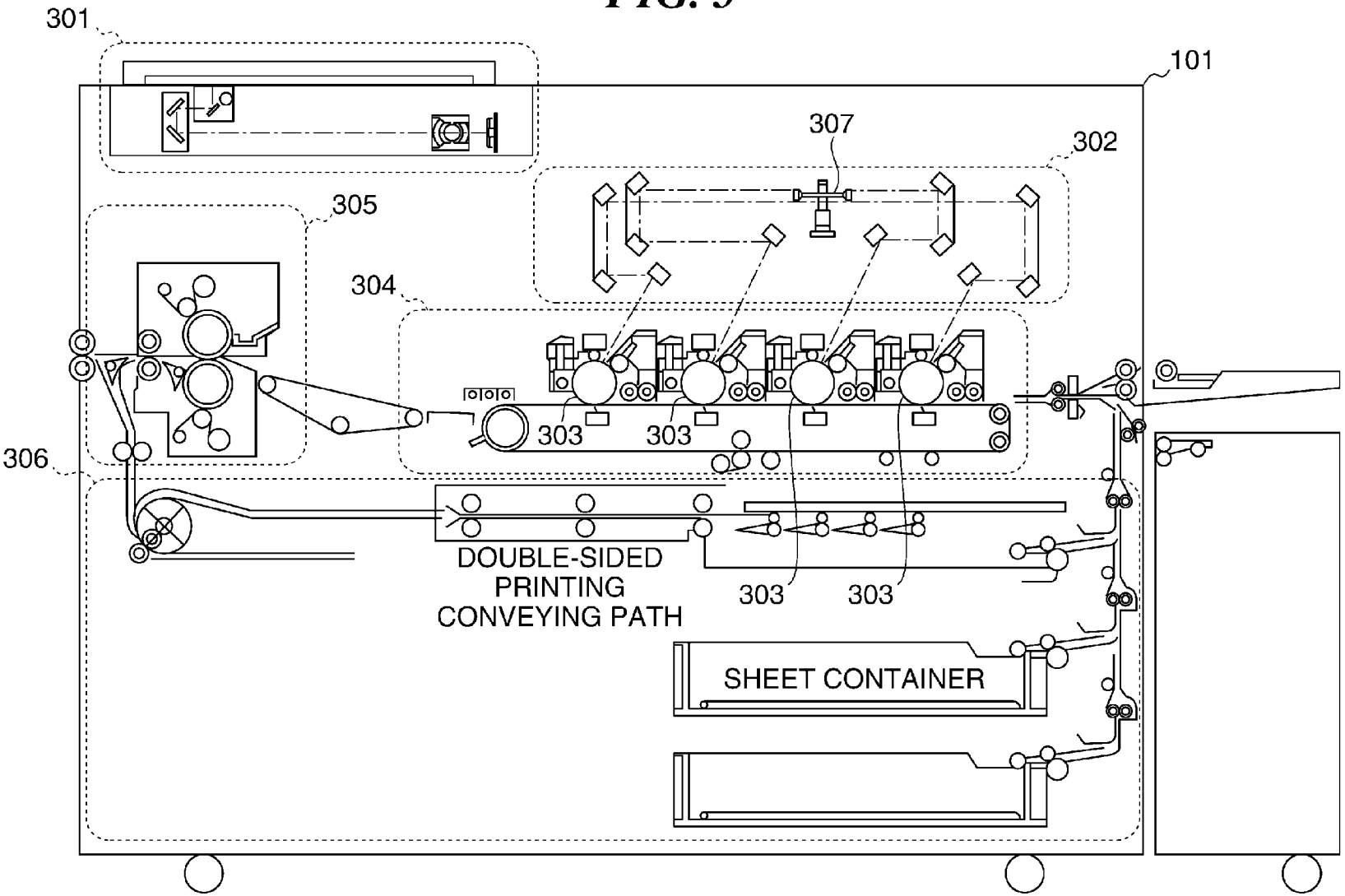
FIG. 3 is a diagram of the hardware configuration of the image forming unit appearing in FIG. 2.

FIG. 3 is a diagram of the hardware configuration of the image forming unit 101 appearing in FIG. 2.

Referring to FIG. 3, the image forming unit 101 comprises a scanner section 301, a laser exposure section 302, an image creation section 304, a fixing section 305, and a sheet feeding and conveying section 306.

The scanner section 301 illuminates an original placed on an original platen glass with light to thereby optically read an original image, and creates image data by converting the read image to an electric signal.

The laser exposure section 302 causes light beams, such as laser beams, modulated according to the image data, to enter a rotating polygon mirror 307 which rotates at an equal angular speed, and thereby irradiates the laser beams as reflected scanning light to photosensitive drums 303.

The image creation section 304 drives the photosensitive drums 303 for rotation, charges the photosensitive drums 303 by respective associated chargers, and develops, with toner, latent images which are formed on the respective photosensitive drums 303 by the laser exposure section 302.

The image creation section 304 is provided with four developing units each of which executes a series of electrophotographic processing, including transferring the toner image onto a sheet, and collecting toner remaining on a photosensitive drum 303 without being transferred at the time. The four developing units are arranged side by side.

The four developing units of cyan (C), magenta (M), yellow (Y), and black (K), which are arranged in the mentioned order, start to execute image creation at a cyan station, and with the lapse of a predetermined time period thereafter, sequentially executes respective operations of creating images of magenta, yellow, and black.

This timing control causes the images of toner of the four colors to be transferred onto a sheet without color shift, to thereby form a full-color toner image thereon. Although the present embodiment is assumed to be applied to a color printer, this is not limitative, but in a case where it is applied to a monochrome printer, the developing unit is formed by only the black developing unit.

The fixing section 305 is formed by a combination of rollers and belts, and has a heat source, such as a halogen heater, incorporated therein, for melting and fixing the toner transferred onto the sheet by the image creation section 304, with heat and pressure.

The sheet feeding and conveying section 306 has one or more sheet containers typified by a sheet cassette or a paper deck, separates one from a plurality of sheets accommodated in each sheet container, and conveys the separated sheet to the image creation section 304 and the fixing section 305 according to instructions from the image formation controller 203.

The conveyed sheet has the toner images of the respective colors transferred thereon by the developing units, whereby finally, a full-color toner image is formed on the sheet. Further, when printing images on both sides of the sheet, the sheet having passed through the fixing section 305 is controlled to pass along a conveying path provided for conveying the sheet to the image creation section 304 again.

Figure 4A:
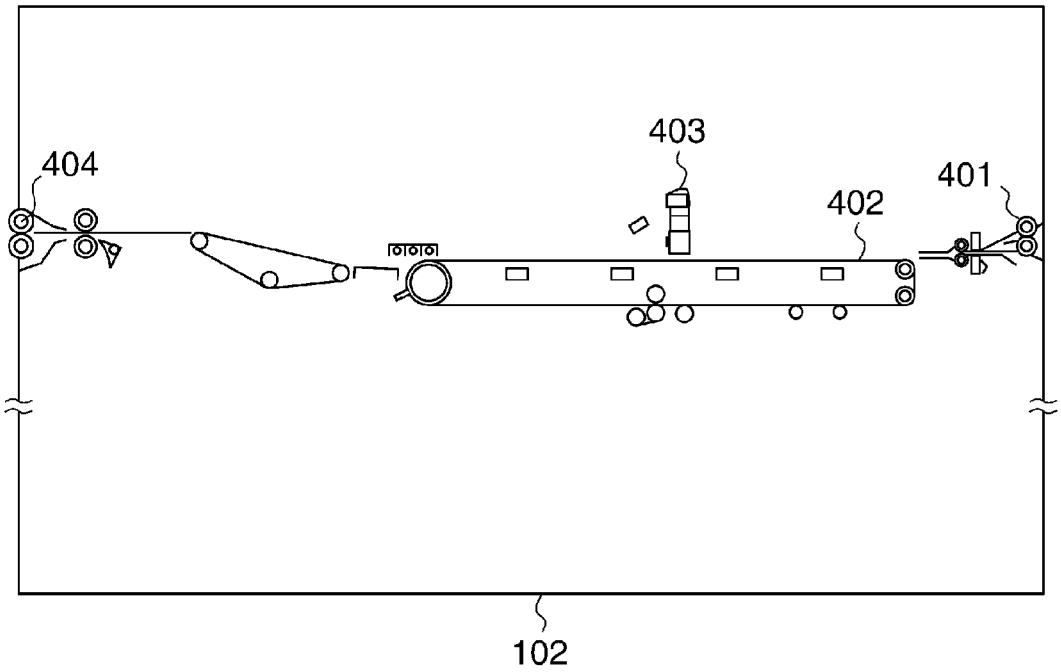
FIGS. 4A and 4B are diagrams of the hardware configuration of the inspection unit appearing in FIG. 2.
Figure 4B:
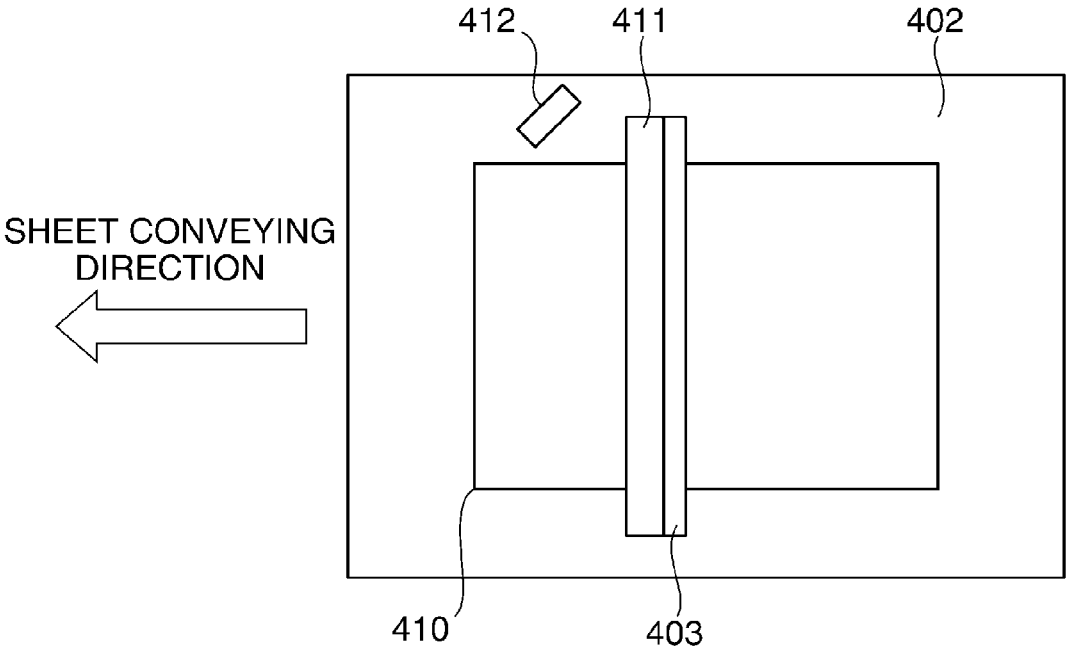

FIGS. 4A and 4B are diagrams of the hardware configuration of the inspection unit 102 appearing in FIG. 2.

FIG. 4A is a schematic cross-sectional view of the inspection unit 102. Printed matter output from the image forming unit 101 is drawn into the inspection unit 102 by a sheet feeding roller 401. Then, a conveying belt 402 conveys the printed matter, and an inspection sensor 403 scans the printed matter being conveyed.

Scanned image data obtained by scanning the printed matter is output to the image forming unit 101. Further, the printed matter is output from a sheet discharge roller 404. Although in FIGS. 4A and 4B, only the inspection sensor 403 is provided, another inspection sensor may be provided under the conveying belt 402 formed of a transparent material at a location opposite to the inspection sensor 403 so as to cope with double-sided printing.

FIG. 4B is a schematic diagram of the inspection unit 102, as viewed from the above. As shown in FIG. 4B, the inspection sensor 403 is a line sensor that reads an image on the whole surface of the printed matter, denoted by reference numeral 410, conveyed thereto, on a line-by-line basis.

Further, a sheet illumination device 411 for image reading illuminates the printed matter when the inspection sensor 403 scans the printed matter.

In order for the inspection sensor 403 to detect, when the printed matter is being conveyed on the conveying belt 402, whether or not the printed matter is skew with respect to a sheet conveying direction, a skew-detecting sheet illumination device 412 illuminates the conveyed sheet from an oblique direction to thereby enable the inspection sensor 403 to read an image of a shadow of an end of the printed matter, for detection of skew of the printed matter.

Although in the present embodiment, the image of the shadow of the end portion of the printed matter is read by the inspection sensor 403, another reading sensor than the inspection sensor 403 may be used.

Figure 5:
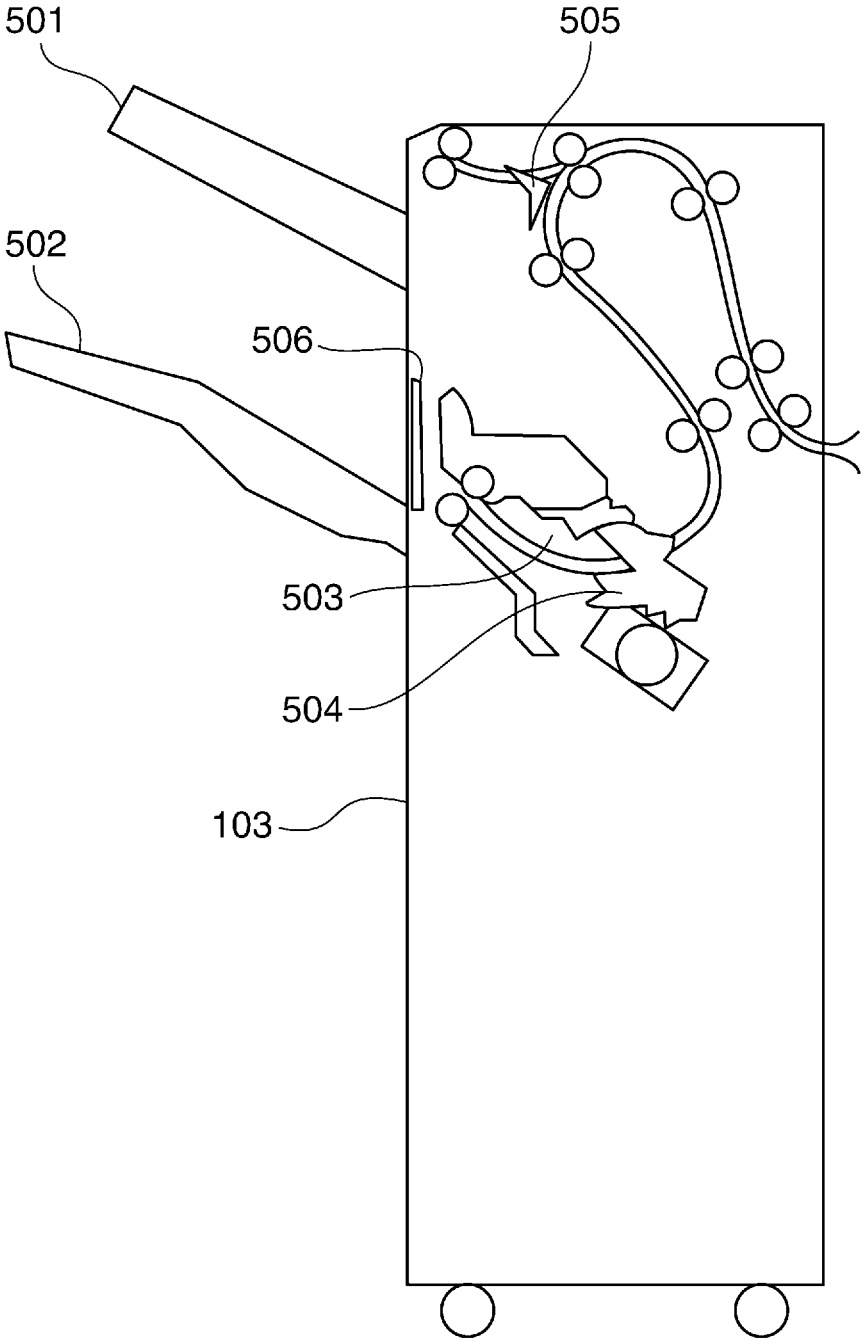
FIG. 5 is a diagram of the hardware configuration of the finisher appearing in FIG. 2.

FIG. 5 is a diagram of the hardware configuration of the finisher 103 appearing in FIG. 2.

Referring to FIG. 5, the finisher 103 is provided with a plurality of sheet discharge trays, and discharges printed matter output from the inspection unit 102 to one of an escape tray 501 and an output tray 502 where sheets are discharged, according to an inspection result. The tray to which sheets are to be discharged can be changed by a transfer path-switching section 505.

Further, in a case where a staple mode is set for the printed matter, the finisher 103 sequentially accumulates the printed matter on a job-by-job basis on a processing tray 503 within the finisher 103, binds the printed matter by a stapler 504 on the processing tray 503, and discharges the printed matter onto the output tray 502.

A sheet aligning section 506 shifts the printed matter discharged onto the output tray 502 in a direction orthogonal to a sheet discharging direction. By shifting the printed matter using the sheet aligning section 506, it is possible to discharge the printed matter in a manner distinct from the other printed matter.

Next, the image forming unit 101 will be described in detail.

Figure 6:
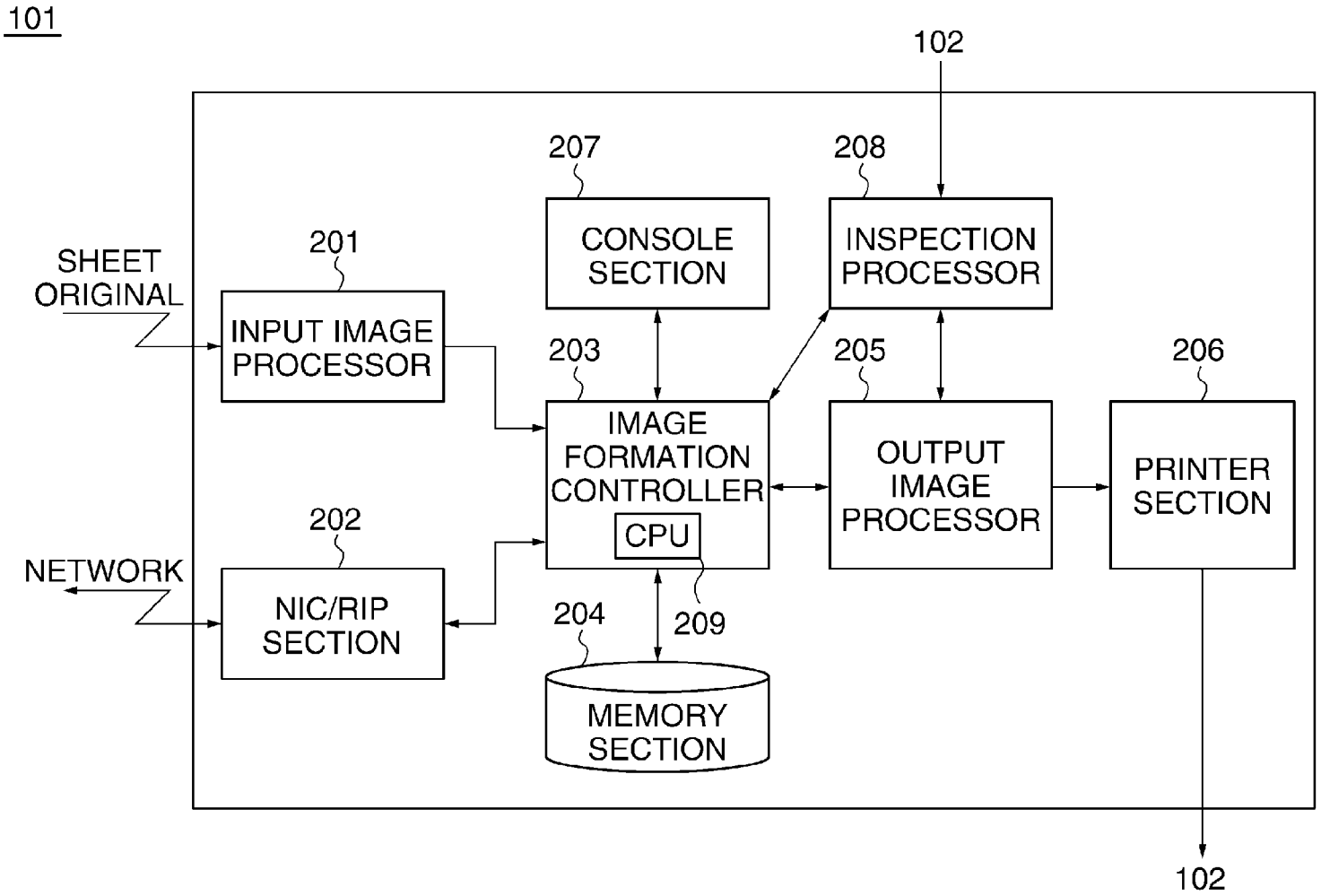
FIG. 6 is a schematic block diagram of the configuration related to the control of the operation of the image forming unit appearing in FIG. 1.

FIG. 6 is a schematic block diagram of the configuration related to the control of the operation of the image forming unit 101 appearing in FIG. 1.

Referring to FIG. 6, an input image processor 201 performs image processing on image data obtained by scanning an original by the scanner section 301.

An NIC/RIP section 202 is formed by an NIC (network interface card) and a RIP (raster image processor).

The NIC receives image data, such as PDL (page description language) data, input using a network, and transmits image data generated by the image forming unit 101 and information on the image forming unit 101 to an external apparatus.

The RIP interprets the received PDL data, and rasterizes the data to bitmap data which can be printed and displayed. The image data rasterized by the RIP is output to the image formation controller 203.

The image formation controller 203 includes a CPU 209, and controls the overall operation of the image forming unit 101. Further, the image formation controller 203 temporarily stores the image data input thereto in a memory section 204. The stored image data is called up as required.

Further, the image formation controller 203 controls the sections appearing in FIGS. 4A and 4B, and manages the states of the scanner section 301, the laser exposure section 302, the image creation section 304, the fixing section 305, and the sheet feeding and conveying section 306, and controls them such that all of them can smoothly operate in a manner harmonious with each other.

An output image processor 205 performs image processing on image data so as to print an image including a copy forgery-inhibited pattern, and outputs the processed image data to a printer section 206 as print data. The output image processor 205 will be described hereinafter.

The printer section 206 feeds a sheet, and prints on the sheet using the print data output from the output image processor 205. The printed matter is output to the inspection unit 102.

A console section 207 is used for receiving user's operations and instructions, and displaying information to a user, and is implemented e.g. by a liquid crystal display (LCD) and an electrostatic capacitive touch panel.

An inspection processor 208 performs processing on image data output from the output image processor 205, and scanned image data, received from the inspection unit 102, of printed matter, to compare the output image data and the scanned image data for inspection of the printed matter. The inspection processor 208 will be described hereinafter.

Figure 7:
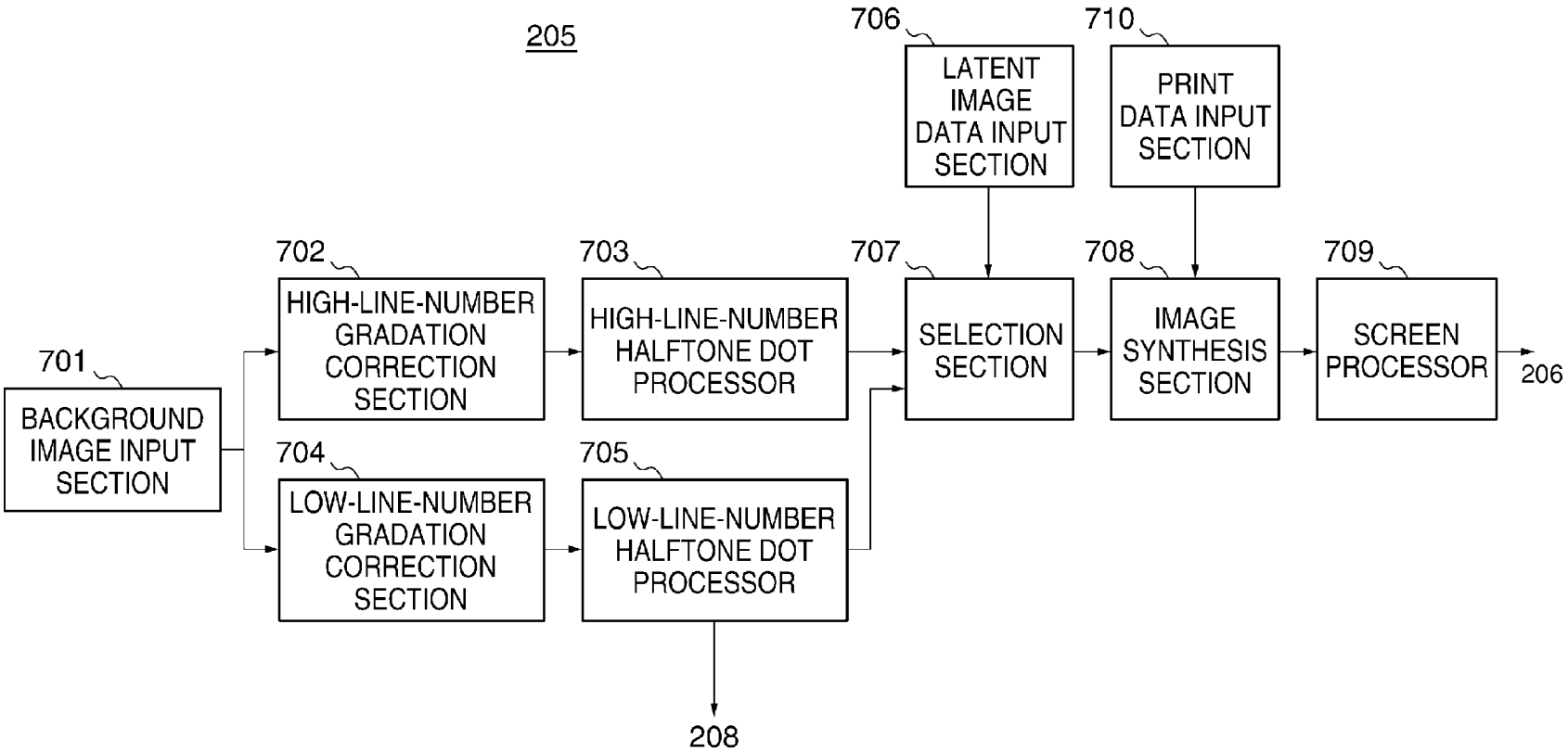
FIG. 7 is a schematic block diagram of an output image processor appearing in FIG. 6.

FIG. 7 is a schematic block diagram of the output image processor 205 appearing in FIG. 6.

Referring to FIG. 7, a background image converted to bitmap data by the NIC/RIP section 202 is input to a background image input section 701.

A high-line-number gradation correction section 702 and a low-line-number gradation correction section 704 perform gradation correction before halftone dot processing such that images subjected to halftone dot processing with high and low numbers of lines become equal in density when printed.

A high-line-number halftone dot processor 703 performs halftone dot processing on a background image subjected to gradation processing, with a high number of lines. A low-line-number halftone dot processor 705 performs halftone dot processing on a background image subjected to gradation processing, with a low number of lines.

A latent image data input section 706 inputs an image data of a latent image to a selection section 707. This image data of the latent image is binary data which expresses an area which is to be caused to appear as a latent image by one value (e.g. 1), and the other areas by the other value (e.g. 0).

According to the value of the input binary image data of the latent image, the selection section 707 performs image selection such that an image subjected to halftone dot processing with a low number of lines is selected for the value (e.g. 1) indicative of each pixel of the latent image part, and an image subjected to halftone dot processing with a high number of lines is selected for the value (e.g. 0) indicative of each pixel of the other part (the background part), to thereby create copy forgery-inhibited pattern data.

A print data input section 710 inputs print data to be synthesized with the copy forgery-inhibited pattern data created by the selection section 707 to an image synthesis section 708.

The image synthesis section 708 creates image data formed by synthesizing the copy forgery-inhibited pattern data created by the selection section 707 and the print data input from the print data input section 710.

A screen processor 709 performs binarization processing on the created image data, and the processed image data is output to the printer section 206. At this time, the copy forgery-inhibited pattern image has already been binarized.

The above description has been given of the configuration in which background image data and latent image data of a copy forgery-inhibited pattern image are input e.g. from the client PC 105 as PDL data, and the copy forgery-inhibited pattern data is created by the image forming unit 101.

On the other hand, copy forgery-inhibited pattern data may be created by the client PC 105 based on the background image data and the latent image data of the copy forgery-inhibited pattern image, and the created copy forgery-inhibited pattern data may be input to the image forming apparatus 100.

Further, the background image data and the latent image data may be prepared by the image forming unit 101 in advance, and image processing may be performed using the prepared background image data and latent image data.

FIG. 8 is a schematic block diagram of the inspection processor 208 appearing in FIG. 6.

Referring to FIG. 8, a print data acquisition section 801 acquires print data to be compared with scanned image data e.g. from the network 106, and outputs the acquired print data to a print data-storing section 802. Note that the inspection unit 102 may be provided with an acquisition interface, and the print data may be acquired via the acquisition interface.

The print data-storing section 802 stores the print data output from the print data acquisition section 801 in the memory section 204.

A copy forgery-inhibited pattern data acquisition section 803 acquires data of the low-line-number halftone dot image created by the low-line-number halftone dot processor 705 of the output image processor 205 and the latent image data, and outputs the acquired data to a copy forgery-inhibited pattern data-storing section 804. The copy forgery-inhibited pattern data-storing section 804 stores the data of the low-line-number halftone dot image and the latent image data output from the copy forgery-inhibited pattern data acquisition section 803 in the memory section 204.

A reference data creation section 805 replaces the value (e.g. 1) representing each area of the latent image part of the binary image data by data of the low-line-number halftone dot image at a corresponding location, but does not change the value (e.g. 0) representing each area of the background part to thereby set 0 (no image).

The reference data creation section 805 performs the above-described processing on the whole page to thereby create data in which only latent image part is expressed by the low-line-number halftone dot image and the background part has no image, and synthesizes the created data and the print data stored in the print data-storing section 802, to thereby create reference data (reference image). Then, a reference data-storing section 806 stores the reference data (reference image) in the memory section 204.

In a case where copy forgery-inhibited pattern printing is not to be executed, synthesis of image data is not performed, and the reference data-storing section 806 stores the print data acquired by the print data acquisition section 801 in the memory section 204 as the reference data.

A resolution conversion section 807 converts the reference data into data of a predetermined resolution, and outputs the reference data subjected to resolution conversion to an image comparison & determination section 510.

On the other hand, a pre-comparison processor 808 receives the scanned image data of the printed matter from the inspection unit 102, and performs correction processing before comparison processing on the scanned image data, such as sheet skew correction.

The scanned image data subjected to correction processing by the pre-comparison processor 808 is output to a resolution conversion section 809. The resolution conversion section 809 converts the scanned image data into data of the predetermined resolution, and outputs the scanned image data subjected to resolution conversion to the image comparison & determination section 510. Although the resolution conversion sections 807 and 809 perform resolution conversion on respective data items, they convert the data items into data items of the same resolution (e.g. 300 dpi).

The image comparison & determination section 510 compares the reference data output from the resolution conversion section 807 and the scanned image data output from the resolution conversion section 809, and outputs a result of comparison to a comparison controller 513 and a determination result-storing section 511.

The determination result-storing section 511 stores the determination result in the memory section 204. A determination result-displaying section 512 displays the determination result on the console section 207 in a case the determination result indicates that the printed matter is defective.

Further, the comparison controller 513 outputs the determination result to the image formation controller 203 and the finisher 103 via an external communication section 514.

Next, a method of creating copy forgery-inhibited pattern data and reference data, executed by the above-described configuration will be described.

Figure 9:
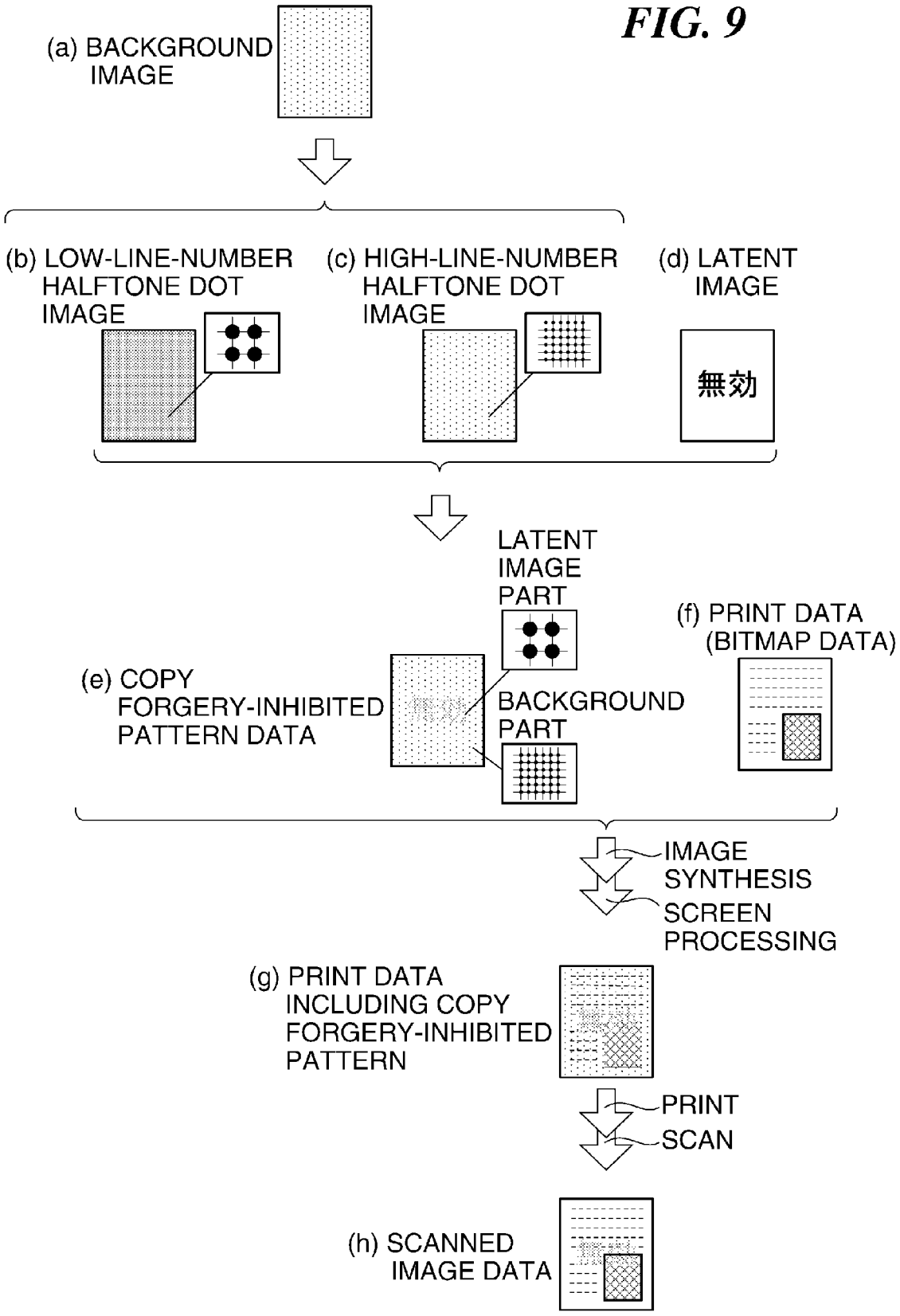
FIG. 9 is a diagram useful in explaining a method of creating copy forgery-inhibited pattern data.

FIG. 9 is a diagram useful in explaining the method of creating copy forgery-inhibited pattern data.

Referring to FIG. 9, the copy forgery-inhibited pattern data is created using a background image (a) expressed by a neutral color and a latent image expressed by binary data.

First, gradation correction is performed before performing halftone dot processing. At this time, gradation correction is performed for image data for halftone dot processing with a high number of lines and for image data for halftone dot processing with a low number of lines, respectively, such that such that the image data created by halftone dot processing with the high number of lines and the image data created by halftone dot processing with the low number of lines will become equal to each other in density.

The halftone dot processing with the high number of lines and halftone dot processing with the low number of lines are performed on the respective image data items on which gradation correction has been performed to thereby create a high-line-number halftone dot image and a low-line-number halftone dot image indicated by (b) and (c), respectively.

The high-line-number halftone dot image and the low-line-number halftone dot image created at this time are used to form a background part and a latent image part of the copy forgery-inhibited pattern, respectively.

Next, using the latent image indicated by (d), an image area is selected from the low-line-number halftone dot image and the high-line-number halftone dot image. The image area is selected in such a manner that when the value of latent image data is a value indicative of an area of the latent image part, data of the low-line-number halftone image is selected, whereas when the same is a value indicative of an area of the background part, data of the high-line-number halftone image is selected.

By creating the image data as described above, the latent image part is formed by the low-line-number halftone dot image, and the background part is formed by the high-line-number halftone dot image, whereby the copy forgery-inhibited pattern data indicated by (e) is created.

Next, the created copy forgery-inhibited pattern data and the print data (f) are synthesized. After that, by performing screen processing, the print data including the copy forgery-inhibited pattern, indicated by (g), is created.

Printing performed based on the print data indicated by (g), which includes the copy forgery-inhibited pattern, gives printed matter on which the background part and the latent image part are printed. When this printed matter is scanned at a resolution (e.g. 600 dpi) which is most generally used, the dots on the background part are not scanned, whereby the scanned image data indicated by (h) on which the latent image part has appeared is obtained.

Figure 10:
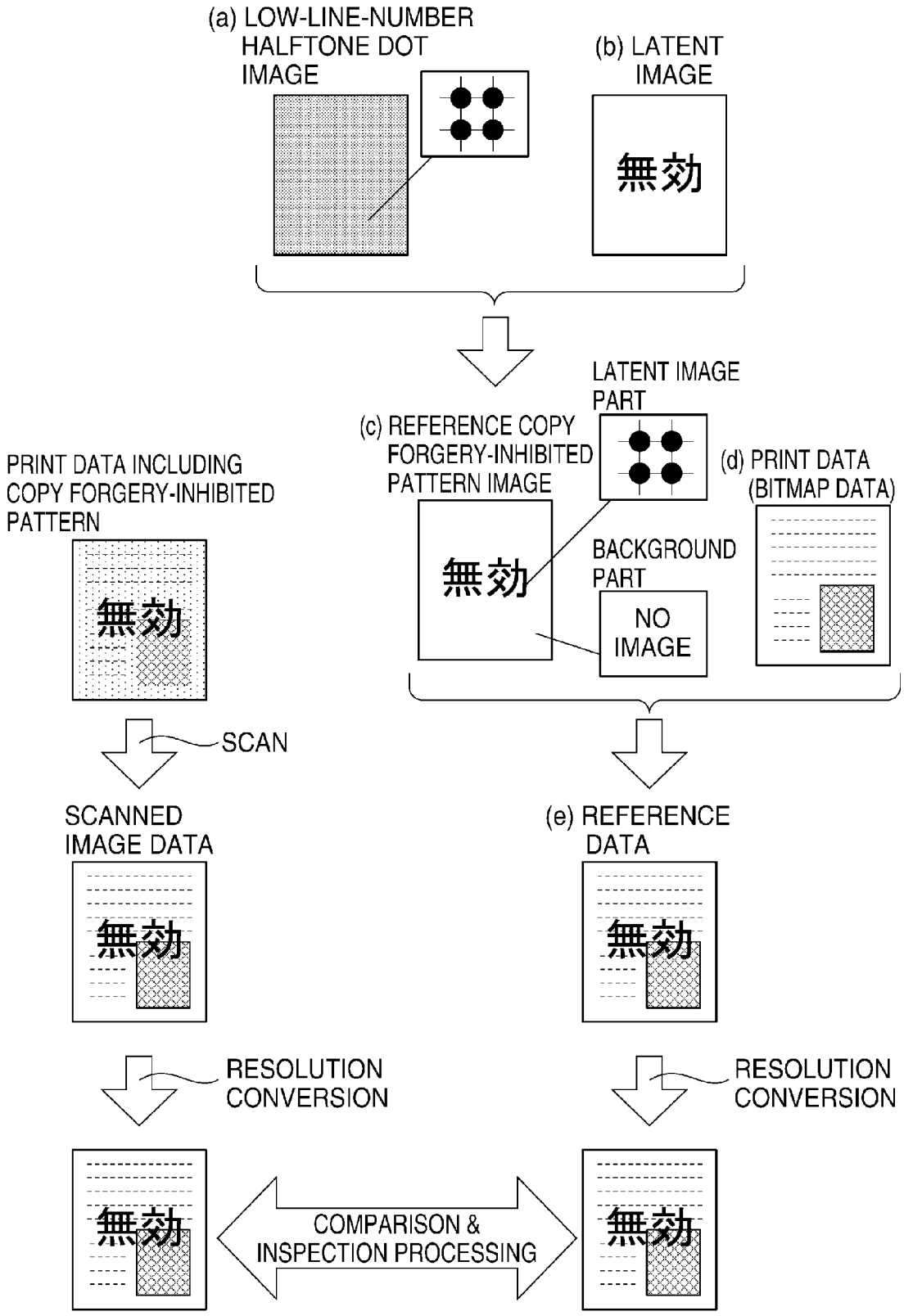
FIG. 10 is a diagram useful in explaining a method of creating reference data.

FIG. 10 is a diagram useful in explaining a method of creating reference data and the like.

Referring to FIG. 10, processing for replacing only the latent image part by a low-line-number halftone dot image indicated by (a) is performed using image data of a latent image indicated by (b). More specifically, there is created data in which the value of the latent image data indicative of each area of the latent image part is replaced by data of the low-line-number halftone dot image and the value of the same indicative of each area of the background part is set to data indicative of no image.

By thus creating the image data, a reference copy forgery-inhibited pattern image indicated by (c) is created in which only the latent image part of the image data of the latent image indicated by (b) is replaced by the low-line-number halftone dot image.

The created reference copy forgery-inhibited pattern image is synthesized with print data indicated by (d), and the obtained synthesized image is set as reference data indicated by (e).

Note that when performing comparison in inspection processing, the created reference data and the scanned image data to be inspected are converted into data of the same resolution (e.g. 300 dpi), respectively, so as to enable proper comparison.

As described above, to inspect printed matter on which a copy forgery-inhibited pattern has been printed, the reference data is created by the above method, whereby the scanned image data and the reference data are made equivalent as shown in FIG. 10, which makes it possible to inspect printed matter having a copy forgery-inhibited pattern printed thereon.

Figure 11:
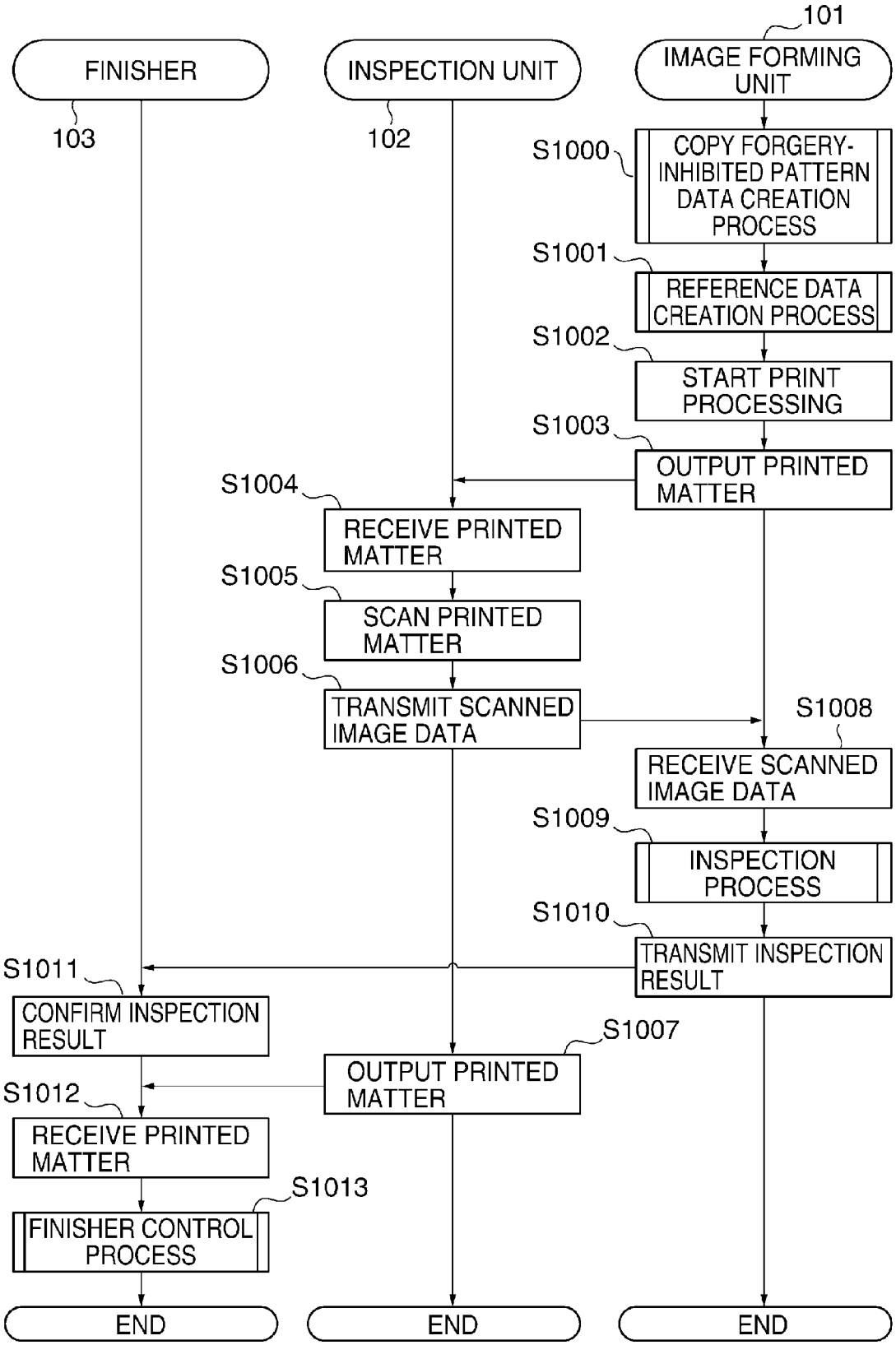
FIG. 11 is a flowchart of an in-line inspection process executed by a CPU appearing in FIG. 6.

FIG. 11 is a flowchart of an in-line inspection process executed by the CPU 209 appearing in FIG. 6.

Although FIG. 11 describes a process executed by the image forming unit 101, the inspection unit 102, and the finisher 103 in cooperation with one another, the CPU 209 of the image formation controller 203 of the image forming unit 101 controls the inspection unit 102 and the finisher 103 via the communication lines mentioned with reference to FIG. 2.

Further, this in-line inspection process shows a process for performing all required operations from image formation, through inspection, up to finishing.

Referring to FIG. 11, the image forming unit 101 executes a copy forgery-inhibited pattern data creation process (step S1000), and executes a reference data creation process (step S1001). The copy forgery-inhibited pattern data creation process and the reference data creation process will be described in detail hereinafter. Further, the step S1001 corresponds to the operation of a reference image creation unit.

Then, the image forming unit 101 starts print processing (step S1002), and outputs the printed matter to the inspection unit 102 (step S1003), and the inspection unit 102 receives the printed matter from the image forming unit 101 (step S1004). The step S1002 corresponds to the operation of an image forming unit configured to form an image including a copy forgery-inhibited pattern on a recording sheet, using print data representative of the image including the copy forgery-inhibited pattern.

Then, the inspection unit 102 scans the printed matter (step S1005), transmits the scanned image data to the image forming unit 101 (step S1006), and outputs the printed matter to the finisher 103 (step S1007). The step S1005 corresponds to the operation of a reading unit configured to read an image from printed matter which is the recording sheet on which the image including the copy forgery-inhibited pattern has been formed.

The image forming unit 101 receives the scanned image data transmitted in the step S1006 (step S1008), executes an inspection process (step S1009), and transmits a result of the inspection to the finisher 103 (step S1010). The inspection process will be described in detail hereinafter. The inspection result is transmitted before the printed matter is output from the inspection unit 102 to the finisher 103 in the step S1007. The step S1009 corresponds to the operation of an inspection unit.

Then, the finisher 103 receives the inspection result from the image forming unit 101, confirms the inspection result (step S1011), and receives the printed matter (step S1012). Then, the finisher 103 executes a finisher control process according to the inspection result (step S1013), followed by terminating the present process. The finisher control process will be described in detail hereinafter.

Note that in a case where a plurality of pages are subjected to the in-line inspection process, the in-line process shown in FIG. 11 is repeatedly executed on a page-by-page basis.

Figure 12:
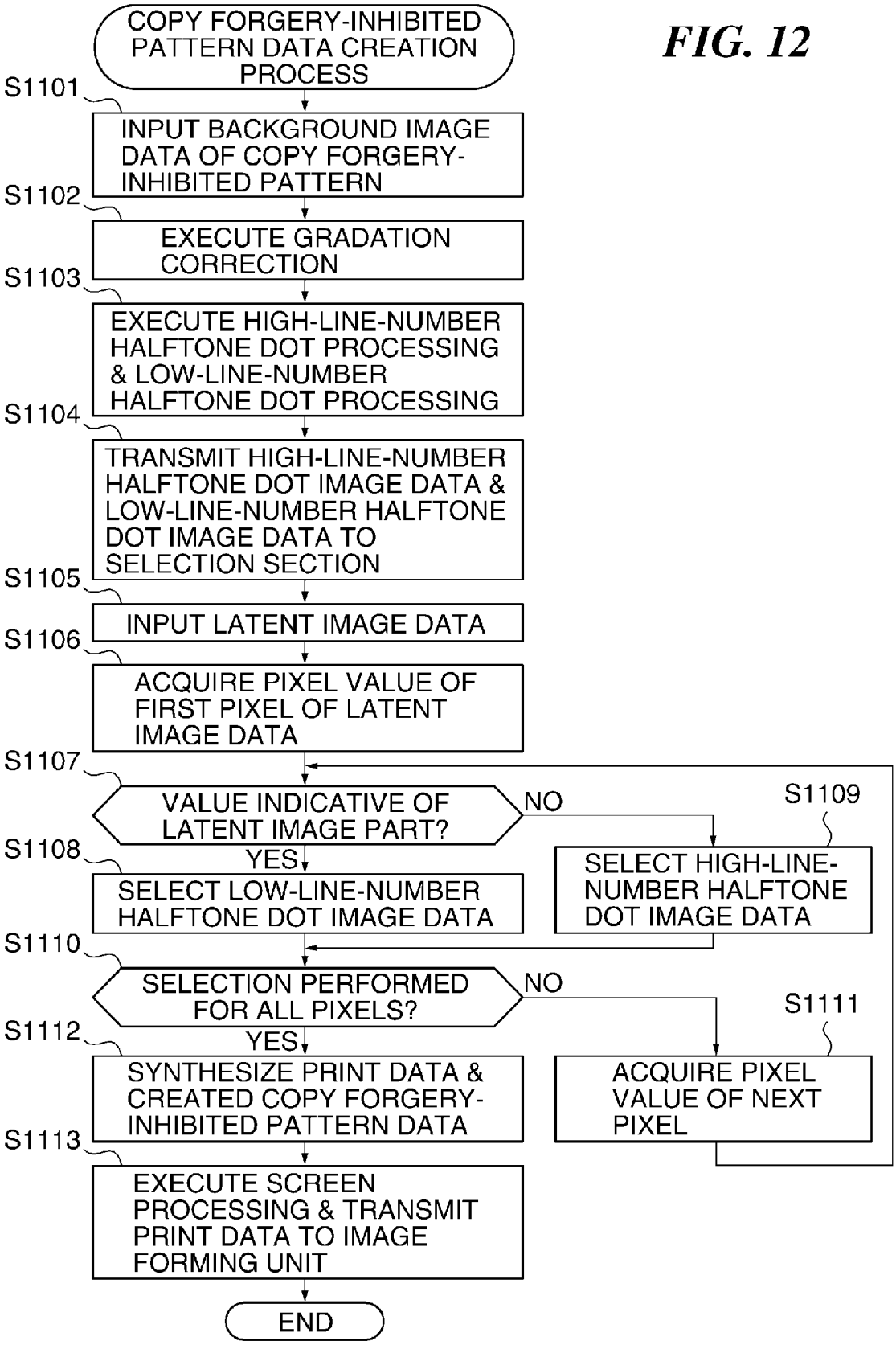
FIG. 12 is a flowchart of a copy forgery-inhibited pattern data creation process executed in a step in FIG. 11.

FIG. 12 is a flowchart of the copy forgery-inhibited pattern data creation process executed in the step S1000 in FIG. 11.

Referring to FIG. 12, the background image input section 701 has background image data of a copy forgery-inhibited pattern image input thereto (step S1101), and the high-line-number gradation correction section 702 and the low-line-number gradation correction section 704 perform gradation correction such that a latent image part and a background part of the background image data subjected to halftone dot processing will become equal to each other in density (step S1102).

Then, the high-line-number halftone dot processor 703 performs halftone dot processing with a high number of lines on the background image data, and the low-line-number halftone dot processor 705 performs halftone dot processing with a low number of lines on the background image data (step S1103).

Then, the high-line-number halftone dot image data created by the high-line-number halftone dot processor 703 and the low-line-number halftone dot image data created by the low-line-number halftone dot processor 705 are transmitted to the selection section 707 (step S1104).

Then, the latent image data is input to the selection section 707 (step S1105), and the selection section 707 acquires a pixel value of a first pixel of the latent image data (step S1106), and determines whether or not the pixel value is a value indicative of each area of the latent image part (step S1107).

If it is determined in the step S1107 that the pixel value is a value indicative of each area of the latent image part (YES to the step S1107), the selection section 707 selects low-line-number halftone dot image data (step S1108) to replace the pixel value by the selected low-line-number halftone dot image data, and the CPU 209 proceeds to a step S1110.

On the other hand, if it is determined in the step S1107 that the pixel value is not a value indicative of each area of the latent image part (NO to the step S1107), the selection section 707 selects high-line-number halftone dot image data (step S1109) to replace the pixel value by the selected high-line-number halftone dot image data, and the CPU 209 proceeds to the step S1110.

Then, the selection section 707 determines whether or not selection processing has been performed for all of the pixels (step S1110).

If it is determined in the step S1110 that selection processing has not been performed for all of the pixels (NO to the step S1110), the selection section 707 acquires a pixel value of the next pixel (step S1111), and returns to the step S1107.

On the other hand, if it is determined in the step S1110 that selection processing has been performed for all of the pixels (YES to the step S1110), the image synthesis section 708 synthesizes the print data and the copy forgery-inhibited pattern data created by the selection section 707 (step S1112), the screen processor 709 executes screen processing on the print data of an image including the copy forgery-inhibited pattern and transmits the print data to the image forming unit 101 (step S1113), followed by terminating the present process.

Figure 13:
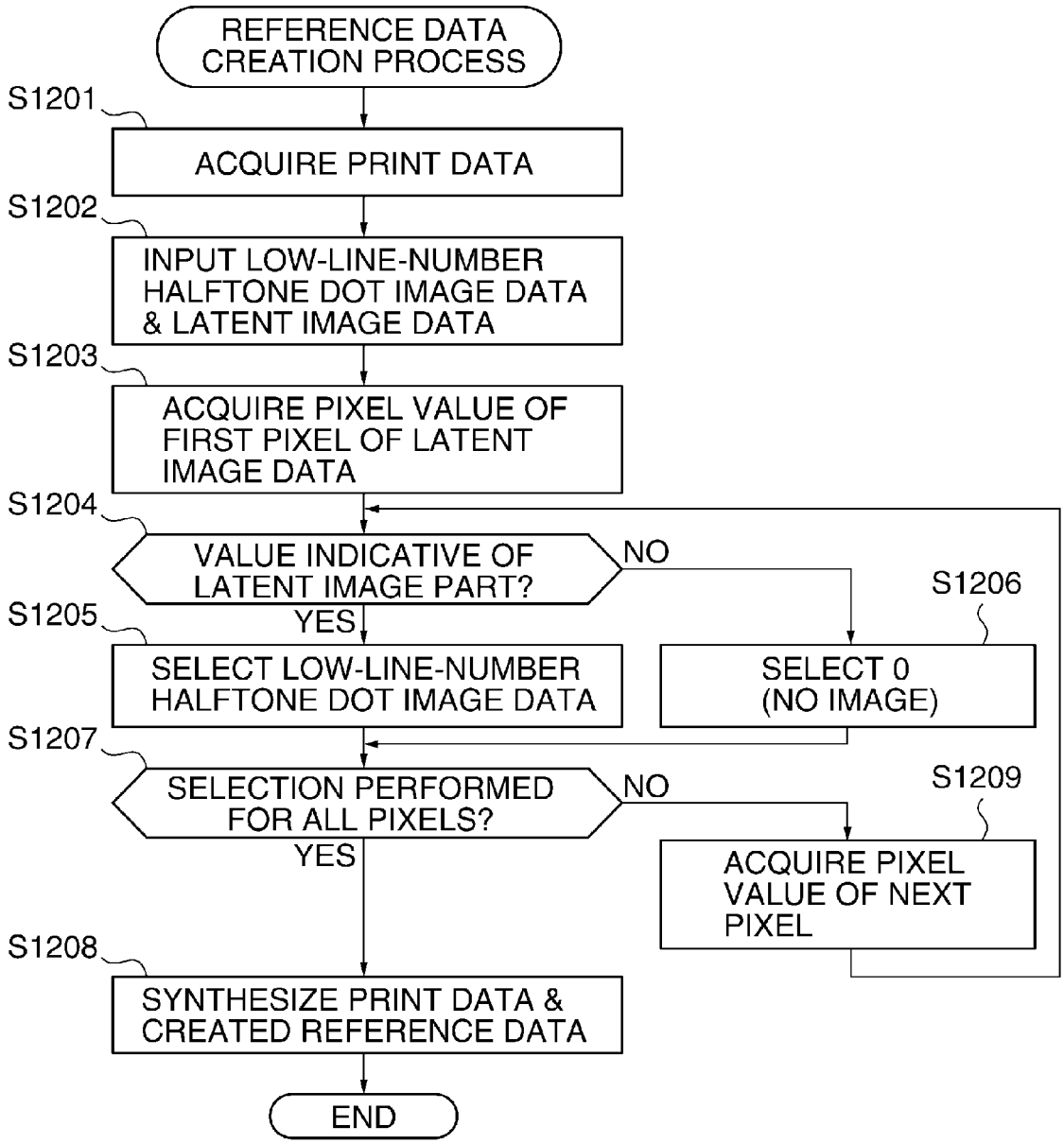
FIG. 13 is a flowchart of a reference data creation process executed in a step in FIG. 11.

FIG. 13 is a flowchart of the reference data creation process executed in the step 1001 in FIG. 11.

Referring to FIG. 13, the print data acquisition section 801 acquires the print data (step S1201), and the copy forgery-inhibited pattern data acquisition section 803 acquires the low-line-number halftone dot image data and the latent image data (step S1202).

Then, the reference data creation section 805 acquires the pixel value of the first pixel of the latent image data (step S1203), and determines whether or not the pixel value is a value indicative of each pixel of the latent image part (step S1204).

If it is determined in the step S1204 that the pixel value is a value indicative of each pixel of the latent image part (YES to the step S1204), the reference data creation section 805 selects data of the low-line-number halftone dot image (step S1205) to thereby replace the value of the pixel in the reference data by data of the low-line-number halftone dot image, and the CPU 209 proceeds to a step S1207.

On the other hand, if it is determined in the step S1204 that the pixel value is not a value indicative of each area of the latent image part (NO to the step S1204), the reference data creation section 805 selects 0 (no image) (step S1206) to thereby set the pixel in the reference data to 0, and the CPU 209 proceeds to the step S1207.

Then, the reference data creation section 805 determines whether or not selection processing has been performed for all of the pixels (step S1207).

If it is determined in the step S1207 that selection processing has not been performed on all of the pixels (NO to the step S1207), the reference data creation section 805 acquires a pixel value of the next pixel (step S1209), and the CPU 209 returns to the step S1204.

On the other hand, if it is determined in the step S1207 that selection processing has been performed for all of the pixels (YES to the step S1207), the reference data creation section 805 synthesizes the print data and the created reference data (step S1208), followed by terminating the present process.

As described above, in the reference data creation process, from the print data, an image is created, as a reference image, in which the images indicative of dots which cannot be read with the resolution with which the printed matter is scanned in the step S1005 (images subjected to high-line-number halftone dot processing) are excluded from the images represented by the print data.

By thus creating the reference data, it is possible to properly compare the reference data with the scanned image data, which makes it possible to execute the inspection process.

Note that in a case where a plurality of pages are subjected to the process, the reference data creation process shown in FIG. 13 is repeatedly executed on a page-by-page basis. As described above, the reference data creation process creates a reference image which is an image obtained by excluding image portions which cannot be read by scan processing by the inspection sensor 403 from an image, including a copy forgery-inhibited pattern, formed on a recording sheet.

Figure 14:
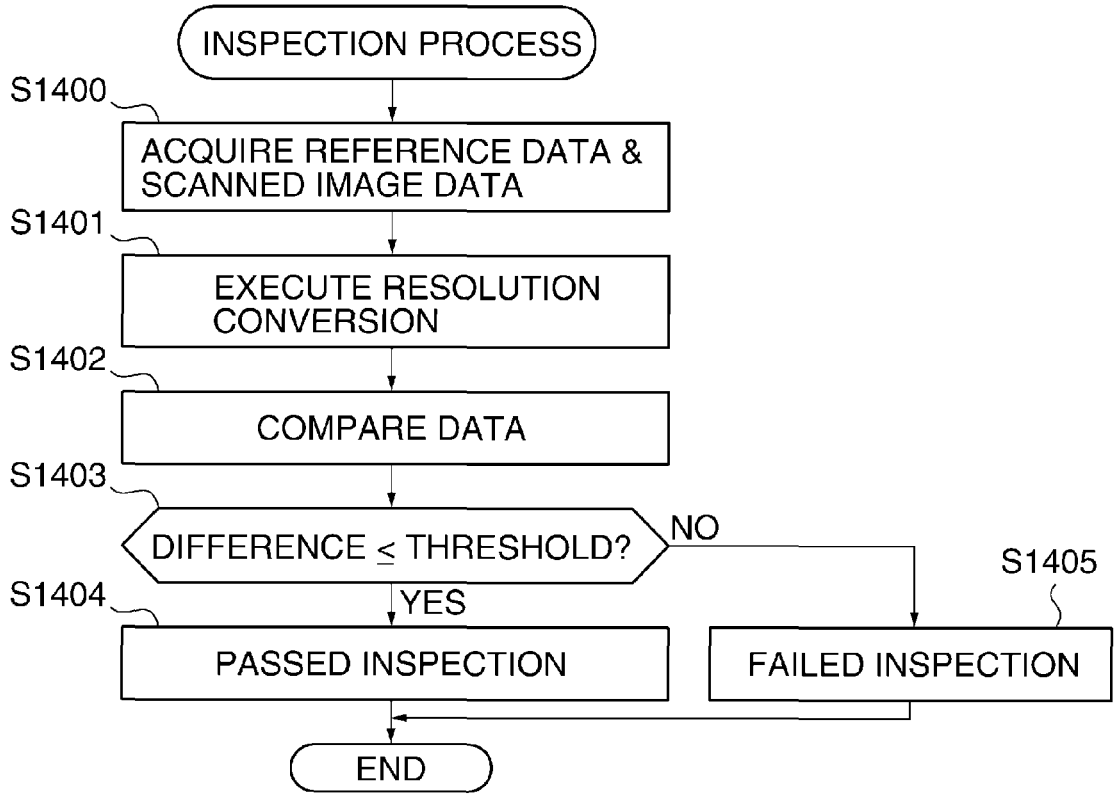
FIG. 14 is a flowchart of an inspection process executed in a step in FIG. 11.

FIG. 14 is a flowchart of the inspection process executed in the step S1009 in FIG. 11.

Referring to FIG. 14, the image comparison & determination section 510 acquires the reference data from the reference data-storing section 806, and acquires the scanned image data of the printed matter to be inspected from the inspection sensor 403 of the inspection unit 102 (step S1400).

Then, the resolution conversion section 807 and the resolution conversion section 809 convert the resolution of the reference data and the resolution of the scanned image data into a resolution which makes it possible to properly compare the reference data and the scanned image data, respectively (step S1401).

Then, the image comparison & determination section 510 compares the reference data and the scanned image data which have been subjected to resolution conversion (step S1402).

The image comparison & determination section 510 determines whether or not a difference between the images subjected to comparison is not more than a predetermined threshold value (step S1403). If it is determined in the step S1403 that the difference is not more than the threshold value (YES to the step S1403), it is determined that the printed matter has passed the inspection (step S1404), followed by terminating the present process.

On the other hand, if it is determined in the step S1403 that the difference is more than the threshold value (NO to the step S1403), it is determined that the printed matter has failed the inspection (step S1405), followed by terminating the present process.

As described above, in the inspection process, printed matter is inspected by comparing a read image which is an image read from the printed matter and a reference image. Further, as described above, in the inspection process, when a difference between the read image and the reference image is not more than a predetermined threshold value, it is determined that the printed matter passes the inspection, whereas when the difference between the read image and the reference image is more than the predetermined threshold value, it is determined that the printed matter fails the inspection.

Examples of the difference between a read image and a reference image include the absolute value of a difference between pixel values of each corresponding pair of pixels of the respective images, and the determination may be performed in such a manner that when the absolute value of differences in all pixels is not more than a predetermined threshold value, it is determined that the printed matter passes the inspection, whereas if not, the printed matter fails the inspection.

Figure 15:
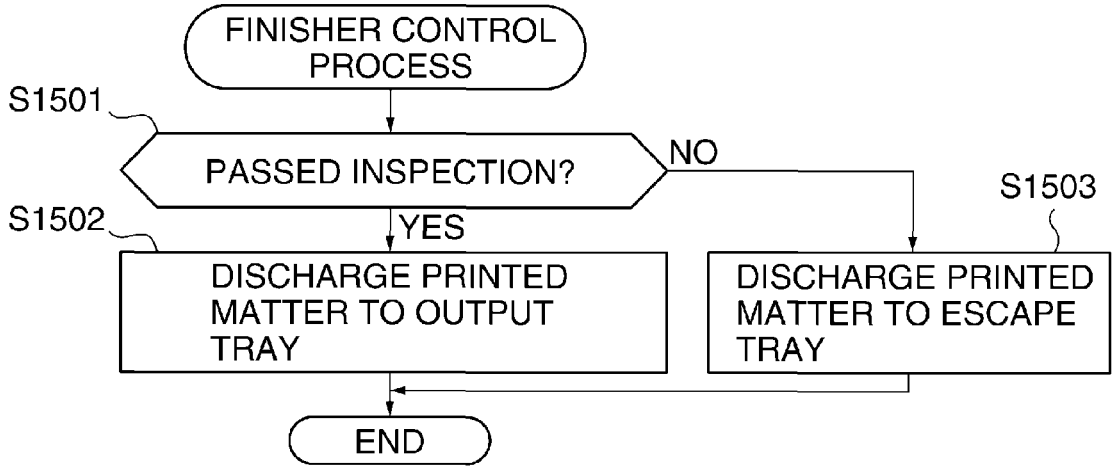
FIG. 15 is a flowchart of a finisher control process executed in a step in FIG. 11.

FIG. 15 is a flowchart of the finisher control process executed in the step S1013 in FIG. 11.

Referring to FIG. 15, the finisher 103 determines whether or not the printed matter has passed the inspection (step S1501).

If it is determined in the step S1501 that the printed matter has passed the inspection (YES to the step S1501), the finisher 103 discharges the printed matter to the output tray 502 (step S1502), followed by terminating the present process.

On the other hand, if it is determined in the step S1501 that the printed matter has failed the inspection (NO to the step S1501), the finisher 103 discharges the printed matter to the escape tray 501 (step S1503), followed by terminating the present process. Thus, the printed matter which has passed the inspection and the printed matter which has failed the inspection are discharged to different discharge trays, respectively.

Note that in a case where a plurality of pages are subjected to the finisher control process, the finisher control process shown in FIG. 15 is repeatedly executed on a page-by-page basis.

According to the above-described process, it is possible to inspect whether or not printed matter is properly printed such that a latent image will correctly appear on the printed matter, on which a copy forgery-inhibited pattern has been printed, when scanned.

Next, a second embodiment of the present invention will be described. According to the first embodiment, it is possible to inspect whether or not printed matter is properly printed such that a latent image will correctly appear on the printed matter, on which a copy forgery-inhibited pattern has been printed, when scanned, i.e. copied. However, what can be confirmed as to the background part is that the background part is not scanned by the inspection sensor 403, but it is impossible to confirm whether the background part has been correctly printed on the printed matter on which the copy forgery-inhibited pattern has been printed.

For example, in a case where dots of the background part are printed as too small dots, the background part is not read by the inspection sensor 403, the printed matter passes the inspection according to the first embodiment, but the background part becomes light-colored, whereby a latent image appears on the printed matter.

Therefore, to inspect whether a latent image is hidden in printed matter on which a copy forgery-inhibited pattern has been printed, it is necessary to inspect whether or not the latent image part and the background part are equal in density.

As a case where the background part is not scanned, there may be mentioned a case where the inspection sensor 403 inspects printed matter using a generally-used resolution, such as 600 dpi.

In view of this, to scan the background part, an inspection sensor of a higher resolution, such as 1200 dpi, is used so as to enable the dots of the background part to be scanned, whereby it is possible to detect densities in the latent image part and the background part. This makes it possible to check whether or not a latent image is hidden in the printed matter.

However, to confirm, from the scanned image data obtained by this inspection sensor, that the background part is not scanned when the printed matter is scanned with the generally-used resolution, it is necessary to perform simulation by taking into account various factors, such as an MTF (modulation transfer function), scanner characteristics, and reflection of light due to influence of a white area around dots.

Therefore, this brings about a problem that when inspection processing is to be executed on a real-time basis, it takes more time in a case where the resolution is high than in a case where the resolution is low. Further, the reading speed of a high-resolution scanner is lower than that of a general-resolution scanner, and hence when taking into account inspection of printed matter without a copy forgery-inhibited pattern, the productivity is reduced.

To solve this problem, in the second embodiment, a description will be given of a method of inspecting whether or not a copy forgery-inhibited pattern has been normally printed on a sheet on which the ground pattern has been printed, using an inspection system equipped with two inspection units. The second embodiment differs from the first embodiment in that the former is equipped with the two inspection units, and the inspection processor thereof performs different processing, and hence the description will be given of the different points.

Figure 16:
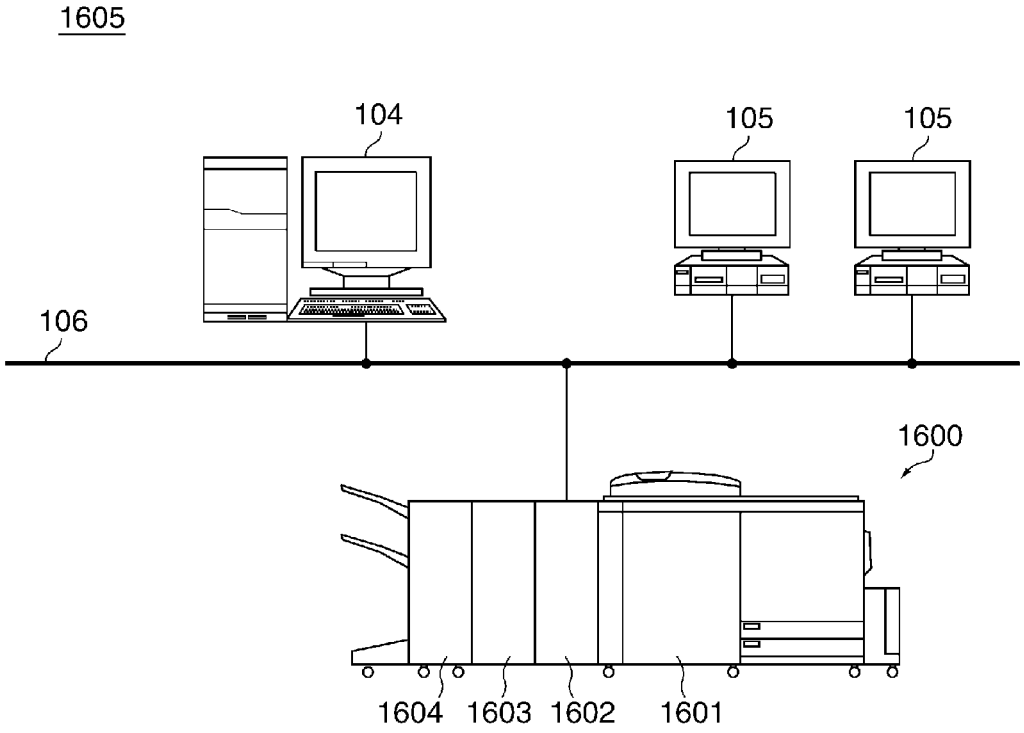
FIG. 16 is a schematic diagram of an image forming system including an image forming apparatus according to a second embodiment of the present invention.

FIG. 16 is a schematic diagram of an image forming system 1605 including an image forming apparatus 1600 according to the second embodiment of the present invention.

Referring to FIG. 16, the image forming system 1605 is the same as the system shown in FIG. 1 except the image forming apparatus 1600.

Further, the image forming apparatus 1600 comprises an image forming unit 1601, inspection units 1602 and 1603, and a finisher 1604.

The image forming unit 1601 outputs printed matter to the inspection unit 1602, the inspection unit 1602 outputs the printed matter to the inspection unit 1603, and the inspection unit 1603 outputs the printed matter to the finisher 1604.

Further, the inspection unit 1602 has the same configuration as that of the inspection unit of the first embodiment, and the inspection unit 1603 is equipped with an inspection sensor of a resolution, such as 1200 dpi, that is capable of scanning small dots used in a background part of a copy forgery-inhibited pattern.

Further, the image comparison & determination section 510 (see FIG. 8) of the inspection processor 208 (see FIG. 6) executes the same processing as executed in the first embodiment on scanned image data scanned by the inspection unit 1602.

On the other hand, as for scanned image data scanned by the inspection unit 1603, the image comparison & determination section 510 detects densities of the latent image part and the background part of the scanned image data, and compares the detected densities.

If a difference in density is not more than a threshold value, it is determined that the printed matter passes the inspection, whereas if not, it is determined that the printed matter fails the inspection, and the image comparison & determination section 510 outputs the inspection result to the finisher 1604 via an external communication section 1706.

Figure 17:
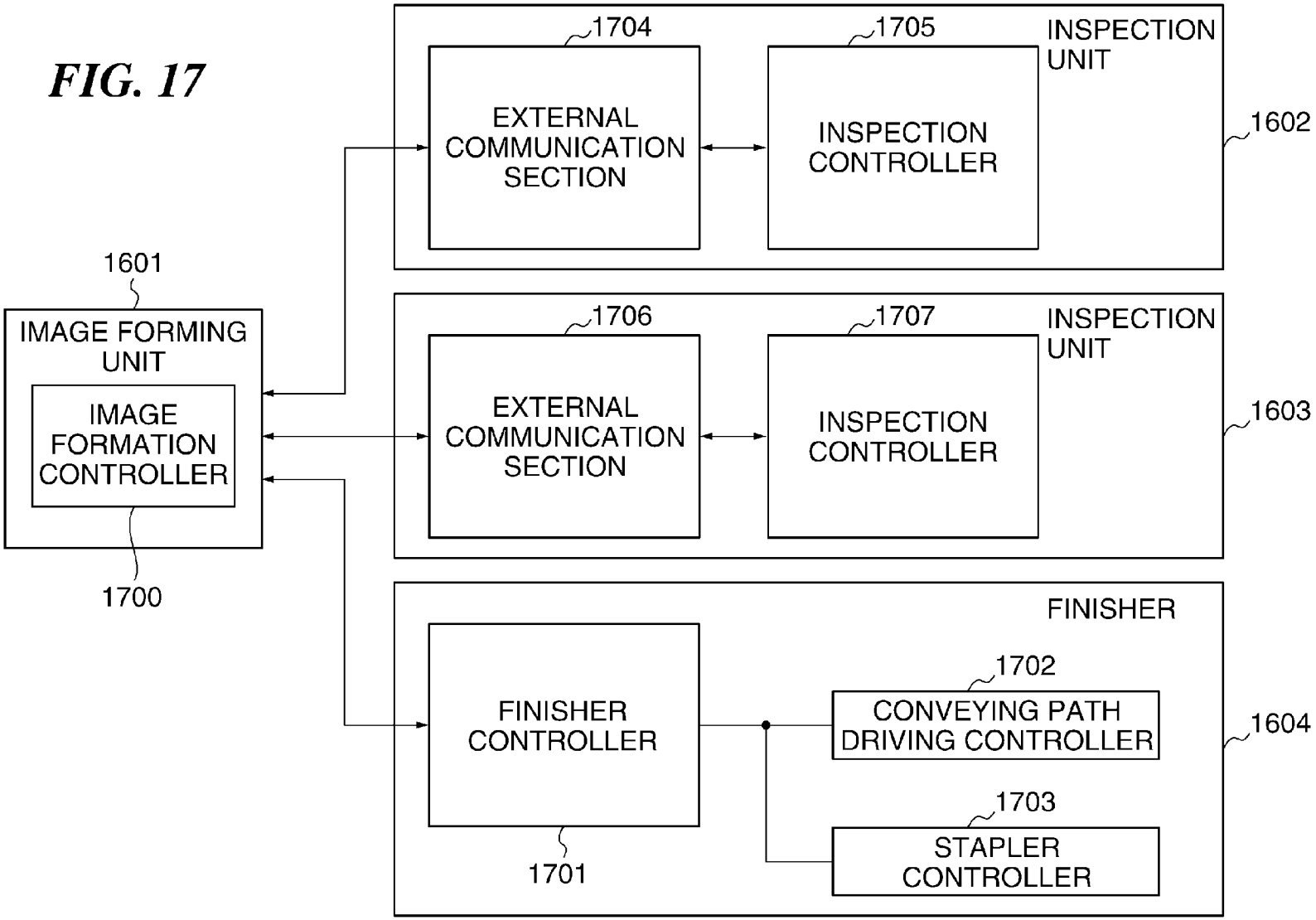
FIG. 17 is a diagram showing respective control-related sections of an image forming unit, an inspection unit, and a finisher of the image forming apparatus appearing in FIG. 16, and a connection relationship between them.

FIG. 17 is a diagram showing respective control-related sections of the image forming unit 1601, the inspection units 1602 and 1603, and the finisher 1604, appearing in FIG. 16, and a connection relationship between them.

Referring to FIG. 17, an image formation controller 1700 is connected to an external communication section 1704, the external communication section 1706, and a finisher controller 1701, via respective dedicated communication lines (not shown).

The external communication sections 1704 and 1706 perform communication with the image forming unit 1601 to receive operation control information and transmit scanned image data, respectively.

Further, inspection controllers 1705 and 1707 perform scanning of print data and let-pass-through control based on control information received from the external communication sections 1704 and 1706, respectively. Further, similar to the first embodiment, the finisher 1604 is equipped with a conveying path driving controller 1702 and a stapler controller 1703.

Figure 18:
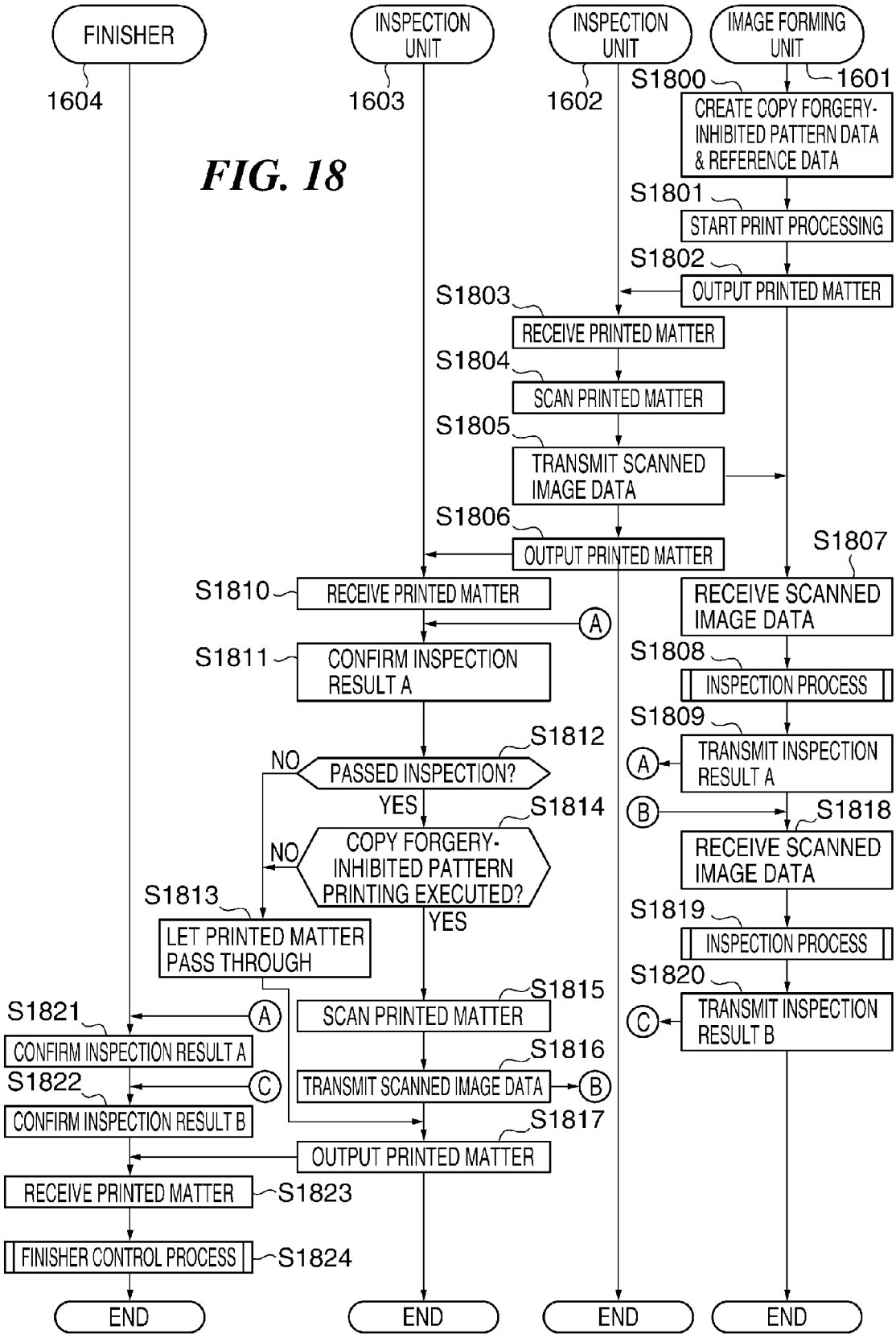
FIG. 18 is a flowchart of an in-line inspection process executed by the CPU appearing in FIG. 6.

FIG. 18 is a flowchart of an in-line inspection process executed by the CPU 209 appearing in FIG. 6.

Although FIG. 18 describes a process executed by the image forming unit 1601, the inspection units 1602 and 1603, and the finisher 1604 in cooperation with one another, the CPU 209 of the image formation controller 1700 of the image forming unit 1601 controls the inspection units 1602 and 1603 and the finisher 1604 via the communication lines mentioned with reference to FIG. 16.

Further, this in-line inspection process shows a process for performing all required operations from image formation, through inspection, up to finishing.

Referring to FIG. 18, the image forming unit 1601 executes the copy forgery-inhibited pattern data creation process described with reference to FIG. 12, and executes the reference data creation process described with reference to FIG. 13 (step S1800).

Then, the image forming unit 1601 starts print processing (step S1801), and outputs the printed matter to the inspection unit 1602 (step S1802), and the inspection unit 1602 receives the printed matter from the image forming unit 1601 (step S1803).

Then, the inspection unit 1602 scans the printed matter (step S1804), transmits the scanned image data to the image forming unit 1601 (step S1805), and outputs the printed matter to the inspection unit 1603 (step S1806).

The image forming unit 1601 receives the scanned image data transmitted in the step S1805 (step S1807), executes the inspection process (step S1808), and transmits an inspection result A to the inspection unit 1603 and the finisher 1604 (step S1809). The inspection process executed in the step S1808 is the inspection process described with reference to FIG. 14.

Then, the inspection unit 1603 receives the printed matter from the inspection unit 1602 (step S1810). Then, the inspection unit 1603 receives the inspection result A from the image forming unit 1601, checks the inspection result A (step S1811), and determines whether or not the inspection result A indicates that the printed matter has passed the inspection (step S1812).

If it is determined in the step S1812 that the inspection result A indicates that the printed matter has failed the inspection (NO to the step S1812), the inspection unit 1603 lets the printed matter pass therethrough without scanning the printed matter (step S1813), and proceeds to a step S1817.

On the other hand, if it is determined in the step S1812 that the inspection result A indicates that the printed matter has passed the inspection (YES to the step S1812), the inspection unit 1603 determines whether or not copy forgery-inhibited pattern printing has been executed (step S1814).

If it is determined in the step S1814 that copy forgery-inhibited pattern printing has not been executed (NO to the step S1814), the inspection unit 1603 proceeds to the step S1813.

On the other hand, if it is determined in the step S1814 that copy forgery-inhibited pattern printing has been executed (YES to the step S1814), the inspection unit 1603 scans the printed matter (step S1815), transmits the scanned image data to the image forming unit 1601 (step S1816), and outputs the printed matter to the finisher 1604 (step S1817). The step S1815 corresponds to the operation of the other reading unit configured to read an image with a higher resolution than the resolution with which the image is scanned in the step S1804.

The image forming unit 1601 receives the scanned image data transmitted in the step S1816 (step S1818), executes an inspection process (step S1819), and transmits an inspection result B to the finisher 1604 (step S1820). The inspection process executed in the step S1819 will be described in detail hereafter. The step S1819 corresponds to the operation of the other inspection unit.

The finisher 1604 receives the inspection result A from the image forming unit 1601 to confirm the inspection result A (step S1821), further receives the inspection result B to confirm the inspection result B (step S1822), and receives the printed matter (step S1823).

Then, the finisher 1604 executes a finisher control process according to the inspection results (step S1824), followed by terminating the present process. The finisher control process executed in the step S1824 will be described hereinafter. Note that in a case where a plurality of pages are to be subjected to the in-line inspection process, the in-line process shown in FIG. 18 is repeatedly executed on a page-by-page basis.

Figure 19:
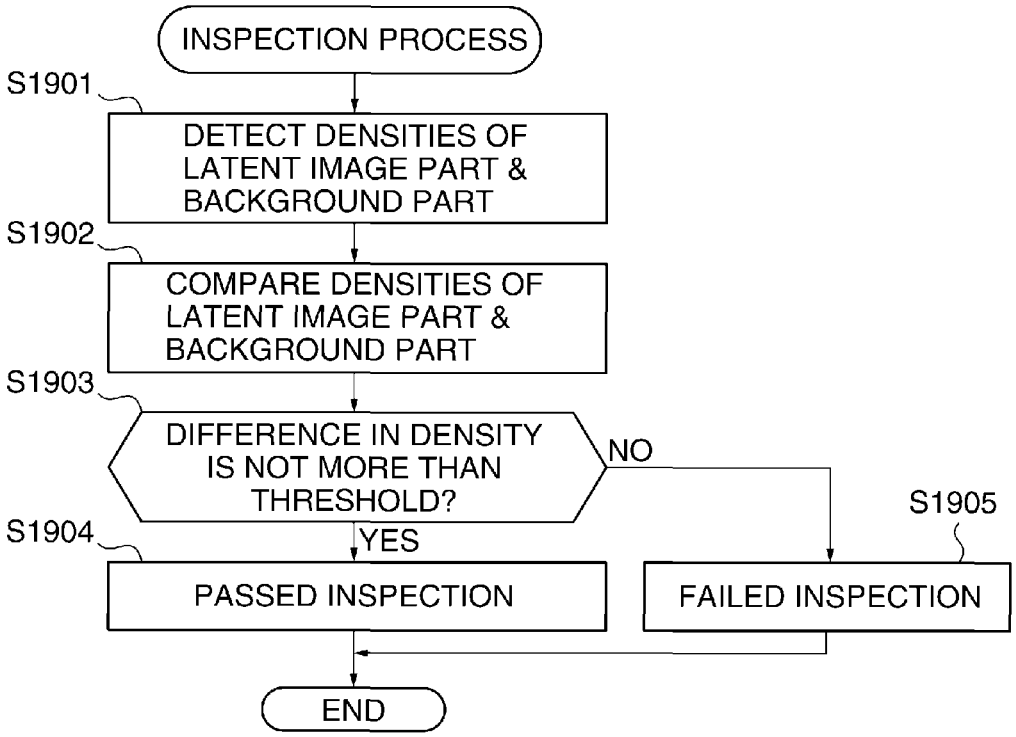
FIG. 19 is a flowchart of an inspection process executed in a step in FIG. 18.

FIG. 19 is a flowchart of the inspection process executed in the step S1819 in FIG. 18.

Referring to FIG. 19, the image comparison & determination section 510 detects densities of the latent image part and the background part of the scanned image data received from the inspection unit 1603 (step S1901), and compares the densities of the latent image part and the background part (step S1902). Note that the background part mentioned here refers to background image data subjected to halftone dot processing with a high number of lines.

Then, the image comparison & determination section 510 determines whether or not a difference in density between the latent image part and the background part is not more than a predetermined threshold value (step S1903). If it is determined in the step S1903 that the difference in density is not more than the threshold value (YES to the step S1903), it is determined that the printed matter has passed the inspection (step S1904), followed by terminating the present process.

On the other hand, if it is determined in the step S1903 that the difference is more than the threshold value (NO to the step S1903), it is determined that the printed matter has failed the inspection (step S1905), followed by terminating the present process.

As described above, in the inspection processing in the step S1819, the printed matter is inspected by comparing density between the copy forgery-inhibited pattern and the background image of the image read in the step S1815. Further, in the inspection processing in the step S1819, when a difference in density between the copy forgery-inhibited pattern and the background image is not more than the predetermined threshold value, and also the printed matter has passed the inspection in the step S1808, it is determined that the printed matter has passed the inspection, whereas when the difference in density is more than the predetermined threshold value, it is determined that the printed matter has failed the inspection.

Figure 20:
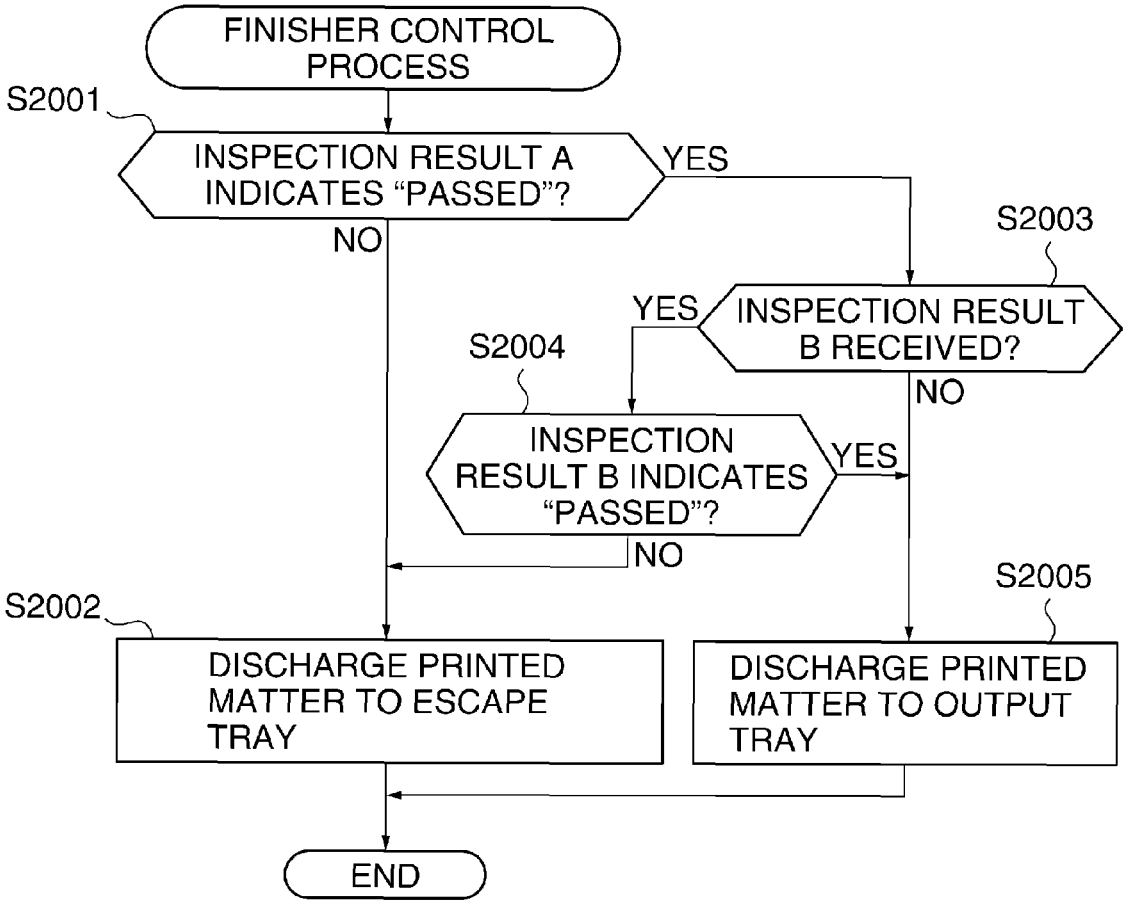
FIG. 20 is a flowchart of a finisher control process executed in a step in FIG. 18.

FIG. 20 is a flowchart of the finisher control process executed in the step S1824 in FIG. 18.

Referring to FIG. 20, the finisher 1604 determines whether or not the inspection result A indicates that the printed matter has passed the inspection (step S2001).

If it is determined in the step S2001 that the inspection result A indicates that the printed matter has failed the inspection (NO to the step S2001), the finisher 1604 discharges the printed matter to the escape tray 501 (step S2002), followed by terminating the present process.

On the other hand, if it is determined in the step S2001 that the inspection result A indicates that the printed matter has passed the inspection (YES to the step S2001), the finisher 1604 determines whether or not the inspection result B has been received (step S2003).

If it is determined in the step S2003 that the inspection result B has not been received (NO to the step S2003), the finisher 1604 discharges the printed matter to the output tray 502 (step S2005), followed by terminating the present process.

On the other hand, if it is determined in the step S2003 that the inspection result B has been received (YES to the step S2003), the finisher 1604 determines whether or not the inspection result B indicates that the printed matter has passed the inspection (step S2004).

If it is determined in the step S2004 that the inspection result B indicates that the printed matter has passed the inspection (YES to the step S2004), the process proceeds to the step S2005.

On the other hand, if it is determined in the step 2004 that the inspection result B indicates that the printed matter has failed the inspection (NO to the step S2004), the process proceeds to the step S2002. Note that in a case where a plurality of pages are subjected to the finisher control process, the finisher control process in FIG. 20 is repeatedly executed on a page-by-page basis.

As described in the present embodiment, by performing inspection on printed matter on which a copy forgery-inhibited pattern has been printed, using the two inspection units, the printed matter can be inspected concerning two items of inspection described hereafter.

Figure 21A:
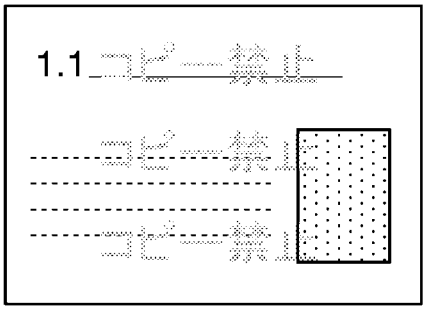
FIG. 21A is a diagram showing scanned image data on which a latent image normally appears.
Figure 21B:
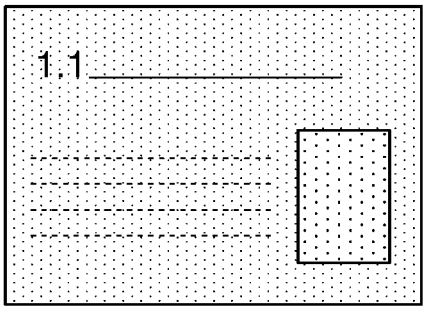
FIG. 21B is a diagram showing printed matter in which a latent image is normally hidden.

FIG. 21A is a diagram showing scanned image data on which a latent image has normally appeared, and FIG. 21B is a diagram showing printed matter in which a latent image is normally hidden.

The first item which can be inspected is whether or not a latent image will correctly appear on a scanned image, as shown in FIG. 21A, and the second item is whether or not a latent image is hidden in printed matter on which a copy forgery-inhibited pattern has been printed, as shown in FIG. 21B.

Even in a case where the above two items are inspected using the two inspection units, it is possible to perform inspection processing without increasing processing time for inspection and reducing productivity.

OTHER EMBODIMENTS

Embodiments of the present invention can also be realized by a computer of a system or apparatus that reads out and executes computer executable instructions recorded on a storage medium (e.g., non-transitory computer-readable storage medium) to perform the functions of one or more of the above-described embodiment(s) of the present invention, and by a method performed by the computer of the system or apparatus by, for example, reading out and executing the computer executable instructions from the storage medium to perform the functions of one or more of the above-described embodiment(s). The computer may comprise one or more of a central processing unit (CPU), micro processing unit (MPU), or other circuitry, and may include a network of separate computers or separate computer processors. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-137954 filed Jul. 1, 2013, which is hereby incorporated by reference herein in its entirety.

What is claimed is:

1. An image forming apparatus comprising:

a printing unit configured to perform printing on a sheet based on print image data;

a reading unit configured to read the sheet on which printing has been performed by said printing unit to thereby acquire inspection product image data;

a generation unit configured to generate reference image data formed by excluding data representative of image portions which cannot be read by said reading unit, from the print image data; and a determination unit configured to determine whether or not the sheet on which printing has been performed is free from defective printing by comparing the inspection product image data and the reference image data.

2. The image forming apparatus according to claim 1, further comprising a sheet discharge unit configured to discharge, when it is determined by said determination unit that the sheet on which printing has been performed is free from defective printing, the sheet determined to be free from defective printing, to a predetermined sheet discharge tray, and discharge, when it is determined by said determination unit that the sheet on which printing has been performed has defective printing, the sheet determined to have defective printing, to a sheet discharge tray which is different from the predetermined sheet discharge tray.

3. The image forming apparatus according to claim 1, wherein when a difference between the inspection product image data and the reference image data is not more than a predetermined threshold value, said determination unit determines that the sheet on which printing has been performed is free from defective printing, whereas when the difference between the inspection product image data and the reference image data is more than the predetermined threshold value, said determination unit determines that the sheet on which printing has been performed has defective printing.

4. The image forming apparatus according to claim 1, wherein the print image data includes copy forgery-inhibited pattern image data formed by image data representative of large dots and image data representative of small dots, and wherein said generation unit generates the reference image data by excluding the image data representative of the small dots from the print image data.

5. An image forming apparatus comprising:

a printing unit configured to perform printing on a sheet based on synthesized image data formed by synthesizing copy forgery-inhibited pattern image data formed by image data representative of large dots and image data representative of small dots, and print image data;

a reading unit configured to read the sheet on which printing has been performed by said printing unit to thereby acquire inspection product image data;

a generation unit configured to generate reference image data formed by the image data representative of the large dots and the print image data without including image data representative of the small dots; and a determination unit configured to determine whether or not the sheet on which printing has been performed is free from defective printing by comparing the inspection product image data and the reference image data.

6. The image forming apparatus according to claim 5, further comprising a sheet discharge unit configured to discharge, when it is determined by said determination unit that the sheet on which printing has been performed is free from defective printing, the sheet determined to be free from defective printing, to a predetermined sheet discharge tray, and discharge, when it is determined by said determination unit that the sheet on which printing has been performed has defective printing, the sheet determined to have defective printing, to a sheet discharge tray which is different from the predetermined sheet discharge tray.

7. The image forming apparatus according to claim 5, wherein when a difference between the inspection product image and the reference image is not more than a predetermined threshold value, said determination unit determines that the sheet on which printing has been performed is free from defective printing, whereas when the difference between the inspection product image and the reference image is more than the predetermined threshold value, said determination unit determines that the sheet on which printing has been performed has defective printing.

8. A method of controlling an image forming apparatus, comprising:

performing printing on a sheet based on print image data;

reading the sheet on which printing has been performed to thereby acquire inspection product image data;

generating reference image data formed by excluding data representative of image portions which cannot be read by said reading, from the print image data; and determining whether or not the sheet on which printing has been performed is free from defective printing by comparing the inspection product image data and the reference image data.

9. A method of controlling an image forming apparatus, comprising:

performing printing on a sheet based on synthesized image data formed by synthesizing copy forgery-inhibited pattern image data formed by image data representative of large dots and image data representative of small dots, and print image data;

reading the sheet on which printing has been performed to thereby acquire inspection product image data;

generating reference image data formed by the image data representative of the large dots and the print image data without including image data representative of the small dots; and determining whether or not the sheet on which printing has been performed is free from defective printing by comparing the inspection product image data and the reference image data.

10. A non-transitory computer-readable storage medium storing a computer-executable program for executing a method of controlling an image forming apparatus, wherein the method comprises:

performing printing on a sheet based on print image data;

reading the sheet on which printing has been performed to thereby acquire inspection product image data;

generating reference image data formed by excluding data representative of image portions which cannot be read by said reading, from the print image data; and determining whether or not the sheet on which printing has been performed is free from defective printing by comparing the inspection product image data and the reference image data.

11. A non-transitory computer-readable storage medium storing a computer-executable program for executing a method of controlling an image forming apparatus, wherein the method comprises:

performing printing on a sheet based on synthesized image data formed by synthesizing copy forgery-inhibited pattern image data formed by image data representative of large dots and image data representative of small dots, and print image data;

reading the sheet on which printing has been performed to thereby acquire inspection product image data;

generating reference image data formed by the image data representative of the large dots and the print image data without including image data representative of the small dots; and determining whether or not the sheet on which printing has been performed is free from defective printing by comparing the inspection product image data and the reference image data.

* * * * *